US012805594B2

(12) United States Patent
Carriero

(10) Patent No.: US 12,805,594 B2
(45) Date of Patent: Nov. 24, 2026

(54) TEXTURED SOCKLINER

(71) Applicant: NIKE, Inc., Beaverton, OR (US)

(72) Inventor: Michael A. Carriero, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 18/818,193

(22) Filed: Aug. 28, 2024

(65) Prior Publication Data

US 2026/0060361 A1 Mar. 5, 2026

(51) Int. Cl.

| | |
|---|---|
| ***A43B 17/00*** | (2006.01) |
| ***A43B 1/00*** | (2006.01) |
| ***A43B 5/02*** | (2006.01) |
| ***A43B 13/12*** | (2006.01) |

(52) U.S. Cl.

CPC ..... *A43B 1/0081* (2013.01); *A43B 5/02* (2013.01); *A43B 13/12* (2013.01); *A43B 17/00* (2013.01)

(58) Field of Classification Search

CPC ..... A43B 1/0081; A43B 5/02; A43B 17/00; A43B 17/006

USPC ..... 36/141, 43

See application file for complete search history.

(56) References Cited

U.S. PATENT DOCUMENTS

| | | | |
|---|---|---|---|
| 601,192 | A | 3/1898 | Woodstein |
| 618,559 | A | 1/1899 | Chase |
| 623,350 | A | 4/1899 | Blanc |
| 1,215,198 | A | 2/1917 | Rothstein |
| 1,255,616 | A | 2/1918 | Kappe |
| 1,275,895 | A | 8/1918 | Fox |
| 1,309,958 | A | 7/1919 | Phillips |
| 1,332,331 | A | 3/1920 | Guinzburg |
| 2,139,858 | A | 12/1938 | Schwartz et al. |
| 2,244,031 | A | 6/1941 | Teehan |

(Continued)

FOREIGN PATENT DOCUMENTS

| | | |
|---|---|---|
| EP | 1976403 A1 | 10/2008 |
| EP | 2287395 A1 | 2/2011 |

(Continued)

OTHER PUBLICATIONS

"Adidas Launches X Crazyfast Engineered to Unlock Speed in all Moments ofthe Game", Adidas, adidas.com, Jul. 12, 2023https://web.archive.org/web/20230712103314/https://news.adidas.com/football/adidas-launches-x-crazyfast---engineered-to-unlock-speed-in-all-moments-of-the-game/s/e2ec418f-83f1-493e-a19e-522b5b542c7e.

(Continued)

*Primary Examiner* — Marie D Bays

(74) *Attorney, Agent, or Firm* — BOOKOFF MCANDREWS PLLC.

(57) ABSTRACT

An article of footwear, having a first end portion, a second end portion opposite the first end portion, an upper including a void space extending between the first end portion and the second end portion, and a sole structure comprising: an outsole configured to contact a ground surface, an insole opposite the outsole, and a sockliner comprising a textile material, wherein the textile material has a plurality of hooks or a plurality of spines extending from the sockliner into the void space of the upper. In some embodiments, the sockliner may have a top surface comprising the textile material, wherein the plurality of hooks or the plurality of spines extends into the void space of the upper toward the first end portion.

20 Claims, 19 Drawing Sheets

(56) References Cited

U.S. PATENT DOCUMENTS 2,500,591 A * 3/1950 Watkins ..... A43B 23/22 36/173
3,087,262 A * 4/1963 Russell ..... A43B 13/181 36/28
3,284,931 A 11/1966 Dassler
3,769,723 A 11/1973 Masterson et al.
4,027,406 A 6/1977 Salvatore
4,075,772 A 2/1978 Sicurella
4,180,924 A 1/1980 Subotnick
4,559,722 A 12/1985 Norton
4,856,209 A 8/1989 Kenyon
4,934,070 A * 6/1990 Mauger ..... A43B 13/203 36/43
5,322,056 A * 6/1994 Menghi ..... A43B 13/40 601/134
5,416,987 A 5/1995 Bemis et al.
5,586,398 A 12/1996 Carlson
5,664,342 A * 9/1997 Buchsenschuss ..... A43B 7/146 36/43
5,735,804 A * 4/1998 Chan ..... A61F 5/14 601/134
5,799,414 A * 9/1998 Kellerman ..... A43B 1/0072 36/44
5,836,094 A 11/1998 Figel
5,839,208 A * 11/1998 Huang ..... A43B 13/20 36/28
5,933,984 A 8/1999 Carlson et al.
6,148,544 A 11/2000 Keen et al.
6,177,171 B1 1/2001 Constantinides
6,205,685 B1 * 3/2001 Kellerman ..... A43D 999/00 36/44
6,260,290 B1 7/2001 Chenevert
6,298,582 B1 10/2001 Friton et al.
6,430,847 B2 8/2002 Fusco et al.
6,449,879 B1 9/2002 Fallon et al.
6,505,424 B2 1/2003 Oorei et al.
7,039,977 B2 5/2006 Wilder
7,047,671 B2 5/2006 Steed et al.
7,290,355 B2 11/2007 Labonte
7,316,082 B2 1/2008 Hernandez Martinez-Portillo et al.
D586,108 S 2/2009 Belley et al.
7,854,076 B2 12/2010 Keppler et al.
7,941,944 B2 5/2011 Cagliari
7,975,403 B2 7/2011 Mosher
8,156,664 B2 4/2012 Shepherd et al.
8,277,922 B2 * 10/2012 Tuman ..... A63B 60/00 15/40
8,291,617 B2 10/2012 Halberstadt et al.
8,302,329 B2 11/2012 Hurd et al.
8,464,440 B2 6/2013 Hooper et al.
8,544,191 B2 10/2013 Marvin et al.
8,695,235 B2 4/2014 Perron, Jr.
8,756,834 B1 6/2014 Halberstadt et al.
8,806,776 B2 8/2014 Leick et al.
9,119,441 B2 9/2015 Frappier
9,241,536 B2 1/2016 Smaldone et al.
9,554,621 B2 1/2017 Truelsen
9,578,919 B2 2/2017 Greene et al.
9,635,905 B2 5/2017 Dekovic
9,668,536 B2 6/2017 Surace et al.
9,968,156 B2 5/2018 Huffman et al.
10,085,516 B2 10/2018 Adami et al.
10,188,172 B1 * 1/2019 Wurtz ..... A43B 17/00
10,258,107 B2 4/2019 Surace et al.
10,342,288 B2 7/2019 Yoshida et al.
10,485,289 B2 11/2019 Frank
10,674,787 B2 6/2020 Amis et al.
10,736,382 B2 8/2020 Hatfield et al.
10,750,805 B2 8/2020 Gallagher
10,888,137 B2 * 1/2021 Izquieta Anaut .... A43B 7/1485
10,897,956 B2 1/2021 Hopkins
10,952,489 B2 3/2021 Kormann et al.
11,490,692 B2 11/2022 Wilson, Jr.
11,571,038 B2 * 2/2023 Mason ..... A43B 13/18
11,633,016 B2 4/2023 Orand et al.
11,707,106 B2 7/2023 Aubonnet et al.
11,779,080 B2 10/2023 Meythaler et al.
11,812,820 B2 11/2023 Notrica et al.
11,849,796 B2 12/2023 Tamm
2002/0083622 A1 7/2002 Joubert et al.
2003/0154627 A1 8/2003 Hirayama
2004/0088890 A1 5/2004 Matis et al.
2004/0118018 A1 6/2004 Dua
2004/0221487 A1 11/2004 Fried
2004/0226076 A1 * 11/2004 Chen ..... A43B 17/18 2/239
2005/0011083 A1 * 1/2005 Kosted ..... A43B 1/0081 2/241
2005/0125907 A1 6/2005 Yamasaki et al.
2006/0277796 A1 * 12/2006 Gallegos ..... A43B 1/0081 36/44
2007/0271819 A1 * 11/2007 Chen ..... A43B 1/0081 36/43
2008/0005927 A1 * 1/2008 Hung ..... A43B 13/36 36/15
2009/0100723 A1 4/2009 Farkas et al.
2009/0133288 A1 * 5/2009 Gallegos ..... A43B 7/223 36/71
2010/0018082 A1 1/2010 Stokes
2010/0024248 A1 2/2010 Baker et al.
2010/0037483 A1 2/2010 Meschter et al.
2010/0183814 A1 * 7/2010 Rios ..... A63B 60/00 427/387
2010/0223809 A1 * 9/2010 Hensch ..... A43C 15/16 36/62
2010/0229423 A1 9/2010 Lin
2010/0229426 A1 9/2010 Brown
2011/0185592 A1 8/2011 Nishiwaki et al.
2011/0247239 A1 10/2011 Berend et al.
2011/0308115 A1 12/2011 Le et al.
2011/0314697 A1 * 12/2011 Chang ..... A43B 13/38 428/156
2011/0314703 A1 12/2011 Freitas
2012/0060390 A1 * 3/2012 Hofbauer ..... A43B 3/108 36/28
2012/0115379 A1 5/2012 Kim
2012/0180338 A1 7/2012 Lin
2012/0216422 A1 8/2012 Ikezawa et al.
2012/0216427 A1 8/2012 Tzeng
2012/0317836 A1 12/2012 Voorhees
2013/0219747 A1 8/2013 Lederer
2013/0291293 A1 11/2013 Jessiman et al.
2014/0033575 A1 2/2014 Cruikshank
2014/0047740 A1 2/2014 Tucker et al.
2014/0059886 A1 3/2014 Lyttle et al.
2014/0305007 A1 * 10/2014 Skaggs ..... A43B 1/0081 36/100
2014/0345162 A1 * 11/2014 Mitchell ..... A43B 13/36 36/100
2014/0377488 A1 12/2014 Jamison
2015/0289589 A1 10/2015 Nishiwaki et al.
2015/0290877 A1 10/2015 Darland
2016/0007674 A1 1/2016 Labonte et al.
2016/0227880 A1 8/2016 Champagne et al.
2016/0374432 A1 12/2016 Park
2017/0055639 A1 * 3/2017 Smith ..... A43B 17/006
2017/0231324 A1 * 8/2017 Arquilla ..... A43B 1/0045 36/10
2018/0064204 A1 3/2018 Vallon et al.
2018/0140038 A1 5/2018 Scrafford
2018/0153256 A1 * 6/2018 Mukenev ..... A43B 17/00
2018/0184759 A1 * 7/2018 Cherneski ..... A43B 19/00
2018/0360156 A1 12/2018 Whiteman et al.
2019/0037968 A1 2/2019 DeWillie et al.
2019/0045884 A1 2/2019 Uda et al.
2019/0075887 A1 * 3/2019 Levy ..... A43B 17/14
2019/0082746 A1 3/2019 Storelli et al.
2019/0090586 A1 * 3/2019 Lee ..... A43B 17/14
2019/0159548 A1 5/2019 Strelli et al.
2019/0223545 A1 7/2019 Chang et al.
2019/0239572 A1 8/2019 Abbey et al.

(56) References Cited

U.S. PATENT DOCUMENTS

| | | | | |
|---|---|---|---|---|
| 2019/0297999 | A1 | 10/2019 | Nakaya et al. | |
| 2020/0128917 | A1 | 4/2020 | Felso | |
| 2020/0178647 | A1 | 6/2020 | Smith et al. | |
| 2020/0281325 | A1 | 9/2020 | Marvin et al. | |
| 2020/0390190 | A1* | 12/2020 | Kuo | A43B 13/36 |
| 2021/0000219 | A1* | 1/2021 | Loyley | B32B 5/022 |
| 2021/0078276 | A1 | 3/2021 | Baghdadi et al. | |
| 2021/0186155 | A1* | 6/2021 | Cruise | A43B 7/1464 |
| 2021/0259363 | A1 | 8/2021 | Saatchi | |
| 2021/0259364 | A1 | 8/2021 | Takashima et al. | |
| 2021/0274887 | A1 | 9/2021 | Halligan et al. | |
| 2022/0000651 | A1* | 1/2022 | Robb | A61F 5/14 |
| 2022/0167706 | A1* | 6/2022 | Huang | A43B 17/00 |
| 2022/0175081 | A1 | 6/2022 | Sutherland | |
| 2022/0234336 | A1 | 7/2022 | Baychar | |
| 2023/0011794 | A1* | 1/2023 | Skaja | B29D 35/122 |
| 2023/0117040 | A1 | 4/2023 | Perrin et al. | |
| 2023/0129224 | A1 | 4/2023 | Berrian et al. | |
| 2023/0148709 | A1 | 5/2023 | Bidal et al. | |
| 2023/0301401 | A1 | 9/2023 | Rémy et al. | |
| 2023/0329387 | A1 | 10/2023 | Youngs et al. | |
| 2023/0346081 | A1 | 11/2023 | Bramani et al. | |
| 2023/0354949 | A1* | 11/2023 | Williamson | A43B 3/102 |

FOREIGN PATENT DOCUMENTS

| | | | |
|---|---|---|---|
| EP | 3117729 | A1 | 1/2017 |
| GB | 909667 | A | 10/1962 |
| GB | 1041248 | A | 9/1966 |
| IT | 201700048479 | A1 | 11/2018 |
| KR | 200422443 | Y1 | 7/2006 |
| WO | 8303338 | A1 | 10/1983 |
| WO | 9601574 | A1 | 1/1996 |
| WO | 03043453 | A1 | 5/2003 |
| WO | 2006019042 | A1 | 2/2006 |
| WO | 2015097656 | A1 | 7/2015 |

OTHER PUBLICATIONS

"An Exclusive Look at the Nike Cleats at the 2015 NFL Combine" sneakernews.com (Feb. 23, 2015). https://sneakernews.com/2015/02/23/exclusive-look-nike-cleats-2015-nflcombine/.

"Boxer Shoe," srnc.co.za. Accessed: May 28, 2024. https://web.archive.org/web/20240528024443/https://srnc.co.za/product/boxer-shoe/.

"Canterbury launches most advanced rugby boot ever made", Joe, joe.co.uk, Published Nov. 3, 2023https://web.archive.org/web/20231103144714/https://www.joe.co.uk/sport/canterbury-launches-most-advanced-rugby-boot-ever-made-399140.

"Currex Cleatpro Insoles", Currex, currex.com, Accessed May 27, 2024. https://currex.com/products/cleatpro.

"Endura MT500 Burner Flat Review: First Ride" bikepacking. com (Mar. 1, 2022). https://bikepacking.com/gear/endura-mt500-burner-flat-review/.

"Lakai Manchester Shoes," skateparkoftampa.com. Feb. 1, 2023. https://web.archive.org/web/20230201033145/https:// skateparkoftampa.com/-lakai-manchester-shoes-black-suede-white-8010-710.

"Nike Mercurial Vapor 14 Elite—What is Vaporposite?", Soccer Clets 101,soccercleats101.com, Jun. 19, 2021https://web.archive.org/web/20210619210833/https://www.soccercleats101.com/2021/05/11/nike-mercurial-vapor-14-elite-what-is-vaporposite/.

"Puma Future Ultimate FG/AG Soccer Cleats" www.nikys-sports.com. (Accessed May 27, 2024) https://www.nikys-sports.com/products/future-ultimate-fg-ag-2.

"Shoe Insoles,Heel Insoles,Sponge Shoes Pads with Heel Grips", Amazon,amazon.com, ASIN: B07ZNSN81Q; Date First Available: Oct. 28, 2019. https://www.amazon.com/Insoles-Inserts-Cushions-Metatarsal-Relief/dp/B07ZNSN81Q.

"Transition Mountain Bike Shoes—Men's" www.rei.com (2022) https://www.rei.com/product/205978/ride-concepts-transition-mountain-bikeshoes-mens?sku=2059780014.

"Work Non-Slip Insole", ALine insoles, al;ineinsoles.com, Accessed May 27, 2024https://alineinsoles.com/pages/work-non-slip-insole.

Gearhart, Mark. "Mobil 1 and DVS Shoes Team Up for a Limited Edition Shoe," Oct. 24, 2012.https://www.lsxmag.com/news/mobil-1-and-dvs-shoes-team-up-for-a-limitededition-shoe/.

J.T.Foote. "J.T. Foote Tongue Pads, Large." www.amazon.com Accessed May 27, 2024.https://www.amazon.com/J-T-Foote-Tongue-Pads-Small/dp/B07G3HDL65.

Pedag. "Pedag Supra Tongue Pad." www.amazon.ca Accessed May 27, 2024.https://www.amazon.ca/Pedag-Supra-Tongue-Large-Ounce/dp/B071RSG1XK.

Tursunova, Dilrabo; Ilkhamova, Malokhat; Rakhimov, Saidabbos. "Development of the Design of Children's Shoes for Prevention Ofvalgus Foot," journals.kozminski.cems-j.com. Central European ManagementJournal. vol. 30 Iss. 3 (2022)https://journals.kozminski.cems-j.com/index.php/pl_cemj/pdf/Dilrabo%20Tursunova.pdf.

International Search Report & Written Opinion, PCT/US2025/043947, mailed Dec. 8, 2025. (11 pages).

International Search Report and Written Opinion, PCT/US2025/043955, Dec. 4, 2025. (11 pages).

* cited by examiner

TEXTURED SOCKLINER

FIELD

The present teachings generally include footwear having an asymmetrical heel seam configured to provide a tighter fit around a foot and reduce irritation for the wearer.

BACKGROUND

This section provides background information related to the present disclosure which is not necessarily prior art.

Correct fit is an important consideration with regard to footwear. For example, it is well known that a shoe should be the correct length and width for a wearer's foot. In many contexts, however, other characteristics that contribute to the "feel" of a shoe can also be quite important. One such characteristic is the degree to which a shoe provides the wearer with a sensation of a close fit. In various sports, for example, an athlete may desire a shoe that provides a snug fitting feel while still being relatively lightweight. Another characteristic may be comfort. A shoe may be close fitting, but uncomfortable for the wearer over long periods of time. Continuing with the previous example, athletes may need to wear the shoe for long periods of time during strenuous activity and therefore comfort should be a carefully considered characteristic when designing a shoe. There remains a need for improved footwear having portions of the upper that provide a close-fitting feel while balancing comfort and weight of the shoe for the wearer.

One particular portion of the shoe that may be improved upon to provide a close-fitting and comfortable is the sole of the shoe, particularly the sockliner. A shoe may be close-fitting and comfortable, but allow for some movement of the foot within the shoe. Further, over time and/or during use the shoe may stretch, even slightly. This room, may allow the foot to move within the shoe, which may lead discomfort and irritation to the foot. The space to move the foot may also make it easier for the foot to be unintentionally removed from the shoe. This may lead to an interruption during athletic events to fix the shoe and/or an increased risk of injury. Some shoe designs have designed portions of a sockliner or insole that targeted at reducing or increasing friction in certain directions of foot movement. However, there remains a need for a sockliner that increases friction when the foot is being removed from the shoe, but allows the foot to easily slide into the shoe otherwise.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
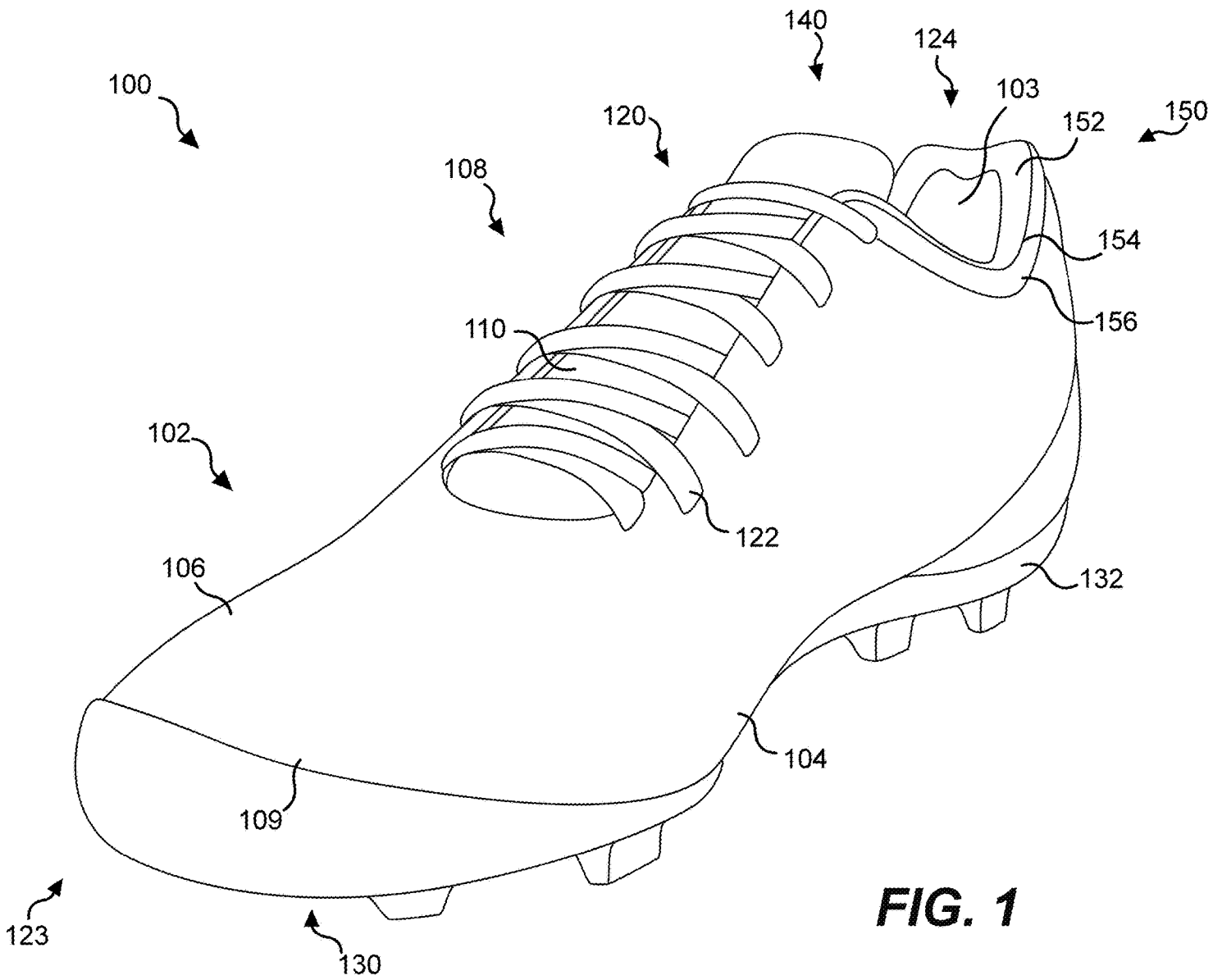
FIG. 1 illustrates an isometric view of an exemplary article of footwear.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly. In some embodiments, the relative terms are with respect to a shoe worn by a wearer, with the wearer's foot on a horizontal surface.

In the discussion that follows, terms "about," "approximately," "substantially," and the like, when used in describing a numerical value, denote a variation of +/−10% of that value, unless specified otherwise FIG. 1 illustrates an exemplary embodiment of an article of footwear 100. For clarity, the following detailed description discusses an exemplary embodiment, in the form of a soccer shoe, but it should be noted that the present invention could take the form of any article of footwear including, but not limited to football shoes, rugby shoes, baseball shoes as well as other kinds of cleated or non-cleated shoes for use in various sports. As shown in FIG. 1, article of footwear 100, may also be referred to simply as article 100. Article 100 is intended to be used with a right foot. The description of article 100 and components of article 100, such as upper 102, tongue 110, fastening system 120, sole structure 130, heel portion 140, and/or collar portion 150, may reference the right foot. However, it should be understood that the following discussion may equally apply to a mirror image of article of footwear 100 that is intended for use with a left foot.

Article of footwear 100 preferably includes upper 102. Generally, upper 102 may be any type of upper. In particular, upper 102 could have any design, shape, size and/or color. Preferably, upper 102 is configured to receive a wearer's foot in a void space created by medial side 104, lateral side 106, and/or intermediate portion 108. In this exemplary embodiment, upper 102 includes opening 103 configured to act as an entry hole to receive a foot of the wearer. The foot of the wearer may be placed in the void space via opening 103.

In some example embodiments, upper 102 is associated with sole structure 130. Sole structure 130 may include an outsole 1104, midsole 132, and/or insole 1101. For the purposes of illustration, outsole 1104 and insole 1101 are not shown in FIG. 1. Outsole 1104 is preferably configured to contact a ground surface, including but not limited to natural grass or synthetic grass. The insole may be configured to contact the foot of a wearer or receive a sockliner, as discussed with reference to FIG. 12-14. Midsole 132 may connect outsole 1104 and/or insole 1101 to upper 102. In some example embodiments, the outsole may have a plurality of protrusions, e.g., cleats or spikes that increase traction between article 100 and the ground. The protrusions may extend from the outside toward a ground surface.

Figure 2:
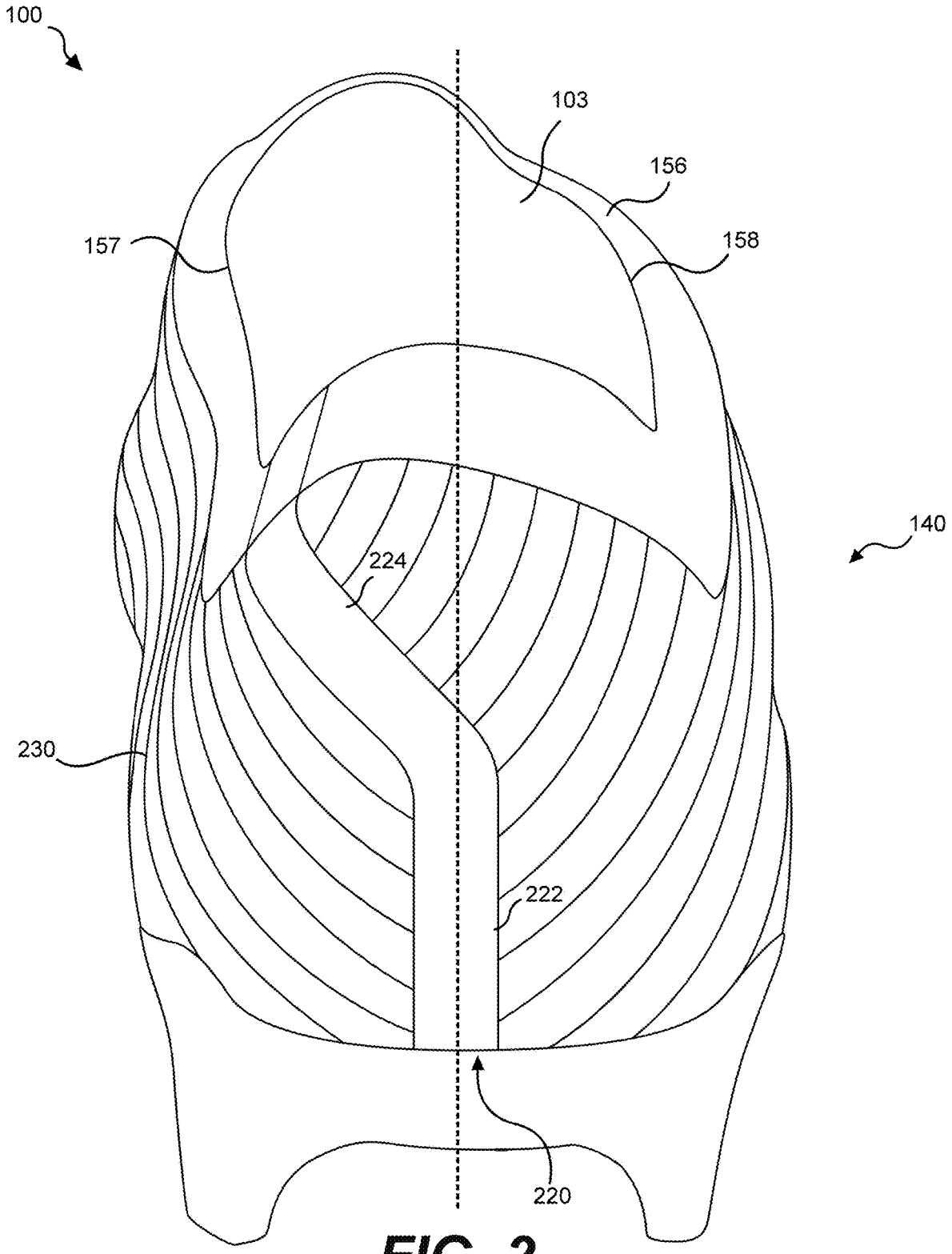
FIG. 2 illustrates a rear view of the exemplary article of footwear including a heel pattern and heel seam configured to provide improved fit and comfort, according to the exemplary embodiment of FIG. 1.

Referring to FIG. 1, upper 102 includes medial side 104 and lateral side 106. Lateral side 106 disposed opposite of medial side 104 as seen in FIG. 2. Furthermore, upper 102 includes intermediate portion 108 disposed between medial side 104 and lateral side 106. Preferably, intermediate portion 108 corresponds to the instep or vamp of upper 102. In some example embodiments, the vamp corresponding to intermediate portion 108 of upper 102 may include multiple layers, such as an overlay, lining, reinforcement, and/or padding. The layers of the vamp may provide cushion, structure, or grip for the shoe. In a preferred embodiment, intermediate portion 108 may partially coincide with tongue 110 of upper 102.

In some cases, portions of upper 102 may include one or more pads. Generally, one or more pads may absorb an impact from contact with other objects, including, but not limited to, balls and ground surfaces. A pad could be disposed on any portion of upper 102. In some embodiments, one or more pads could be associated with medial side 104. In other embodiments, one or more pads could be associated with intermediate portion 108. In a preferred embodiment, one or more pads could be associated with lateral side 106. In some example embodiments, pads may be implemented as a foam piece strategically placed to improve fit and comfort, reduce irritation, and/or increase performance while limiting the added weight of the pad. As discussed further throughout the disclosure, this may be achieve based on design of the foam pad, textile material, and/or placement of the foam pad in the shoe.

In some example embodiments, article of footwear 100 may include a fastening system 120 configured to tighten upper 102. Generally, article of footwear 100 could be associated with any type of fastening system 120 including, but not limited to laces, straps, zippers, hook and loop fasteners, as well as other types of fastening systems. In a preferred embodiment, article of footwear 100 may include a lacing system.

Referring to FIG. 1, article 100 includes fastening system 120 including a fastening mechanism and tongue 110. In some example embodiments, tongue 110 may coincide with intermediate portion 108. Tongue 110 may be coupled to first end portion 123 extend toward second end portion 124. Tongue 110 may end at opening 103. First end portion 123 may be disposed adjacent to toe portion 109. Second end portion 124 may be disposed adjacent to opening 103.

In some example embodiments, fastening system 120 may also be referred to as lacing system 120 in an exemplary embodiment. Fastening system 120 may be used to tighten medial side 104 and lateral side 106 of upper 102 using the fastening mechanism. When fastening system 120 is implemented as a lacing system, lacing system 120 may include a fastening mechanism in the form of laces 122 disposed over tongue 110 of upper 102. Lacing system 120 is disposed from a first (anterior) end portion 123 of article 100 to a second (posterior) end portion 124 of article 100. With this arrangement, laces 122 may tighten lacing system 120 to secure a foot within upper 102.

Generally, lacing system 120 may be disposed in any manner on upper 102. In some example embodiments, lacing system 120 may be disposed symmetrically on intermediate portion 108.

Further, the article of footwear includes a heel portion 140 and a collar portion 150. Collar portion 150 may form a perimeter around at least a portion of the opening 103, where the foot is inserted into article 100. Collar portion 150 may provide structure and support in heel portion 140 of article 100. In some example embodiments, collar portion 150 may include an inner collar lining 152, outer collar lining 156, and topline 154. Inner collar lining 152 may extend inside the shoe to sole structure 130. Collar portion may have an asymmetrical bias to allow for a tight fit for the wearer and increased ankle movement with reduced irritation.

For purposes of clarity, only some portions of upper 102 are discussed in this embodiment. It should be understood that upper 102 may include other provisions that are known in the art for assisting in running, kicking, or other athletic maneuvers.

Referring to FIGS. 2-3, heel portion 140 includes heel seam 220 and a portion of overlay pattern 230 and topline 154 of upper 102. Topline 154 is the top edge of opening 103 or the top edge of upper 102 along opening 103. Heel seam 220 may be configured to connect medial side 104 and lateral side 106 of upper 102. As discussed with reference to FIGS. 15-16, upper 102 may include layers of material selectively arranged to increase comfort and performance of the article 100 while reducing weight of the shoe. Heel seam 220 may be created by the joining of the layers of medial side 104 and lateral side 106 of upper 102. Medial side 104 and lateral side 106 of the layered material of upper 102 may be stitched and/or glued, creating heel seam 220.

In some example embodiments, heel portion 140, including heel seam 220 and the heel portion 140 of overlay pattern 230, may be asymmetric. The term "asymmetric" as used throughout this detailed description and in the claims refers to any arrangement of a component of the shoe that does not extend symmetrically over the medial side and the lateral side of an upper. For example, heel seam 220 may be asymmetric such that a portion of heel seam is disposed on medial side 104 rather than lateral side 106 or vertically where medial side 104 and lateral side 106 meet in heel portion 140. Overlay pattern 230 in heel portion 140 may be correspondingly shifted to match the asymmetry of heel seam 220.

Preferably, asymmetric heel seam 220 may provide greater comfort and a better fit for a wearer. The asymmetric heel seam 220 and corresponding pattern may be configured to increase both comfort and tightness of the shoe by accommodating the "natural fit," e.g., the heel having a wider base at the bottom of the foot and narrowing slightly following the Achilles tendon up the ankle. The asymmetry may have a medial bias that contours this narrowing by wrapping around the medial side of the heel. In some cases, heel seam 220 may be configured with an asymmetrical bias to a medial side of an upper. For example, heel seam 220 may include lower portion 222 and upper portion 224. Lower portion 222 may be connected to or adjacent to midsole 132. Lower portion 222 may be vertically aligned and horizontally centered of heel portion 140 when viewing heel portion 140 from the rear. Upper portion 224 may be connected to the top of lower portion 222 and positioned diagonally toward medial side 104 of upper 102, creating an asymmetrical heel seam 220. Upper portion 224 may be positioned diagonally toward medial side 104 of upper 102 connecting medial side 104 and lateral side 106 of upper 102 between lower portion 222 and topline 154.

As shown in FIG. 2, the diagonal angle, e.g., medial bias, of upper portion 224 may allow upper portion 224 and to meet topline 154 between the medial malleolus bone and Achilles tendon of the foot of the wearer. For example, FIG. 2 includes a vertical axis, horizontally centered at heel portion 140. The diagonal angle of the medial bias, or offset from the vertical axis, may range from 10-45° toward medial side 104. The design of article 100 may have a thick outer collar lining 156. In some embodiments, upper portion 224 of heel seam 220 may extend through outer collar lining 156 to meet topline 154. Additionally, in some embodiments, the angle of upper portion 224 may dependent on the collar hang of collar portion 150, such that upper portion 224 of heel seam 220 may meet topline 154 and/or outer collar lining 156 between the medial malleolus bone and the Achilles tendon of the wearer. In some example embodiments, the angle may range depending on the wearer and each foot of the wearer, such that the bias of heel seam 220 may be customizable to the individual wearer. In some example embodiments, heel seam 220 may have a lateral bias. Upper portion 224 may have a diagonal offset from the vertical axis shown in FIG. 2, toward lateral side 106 of upper 102.

Figure 3A:
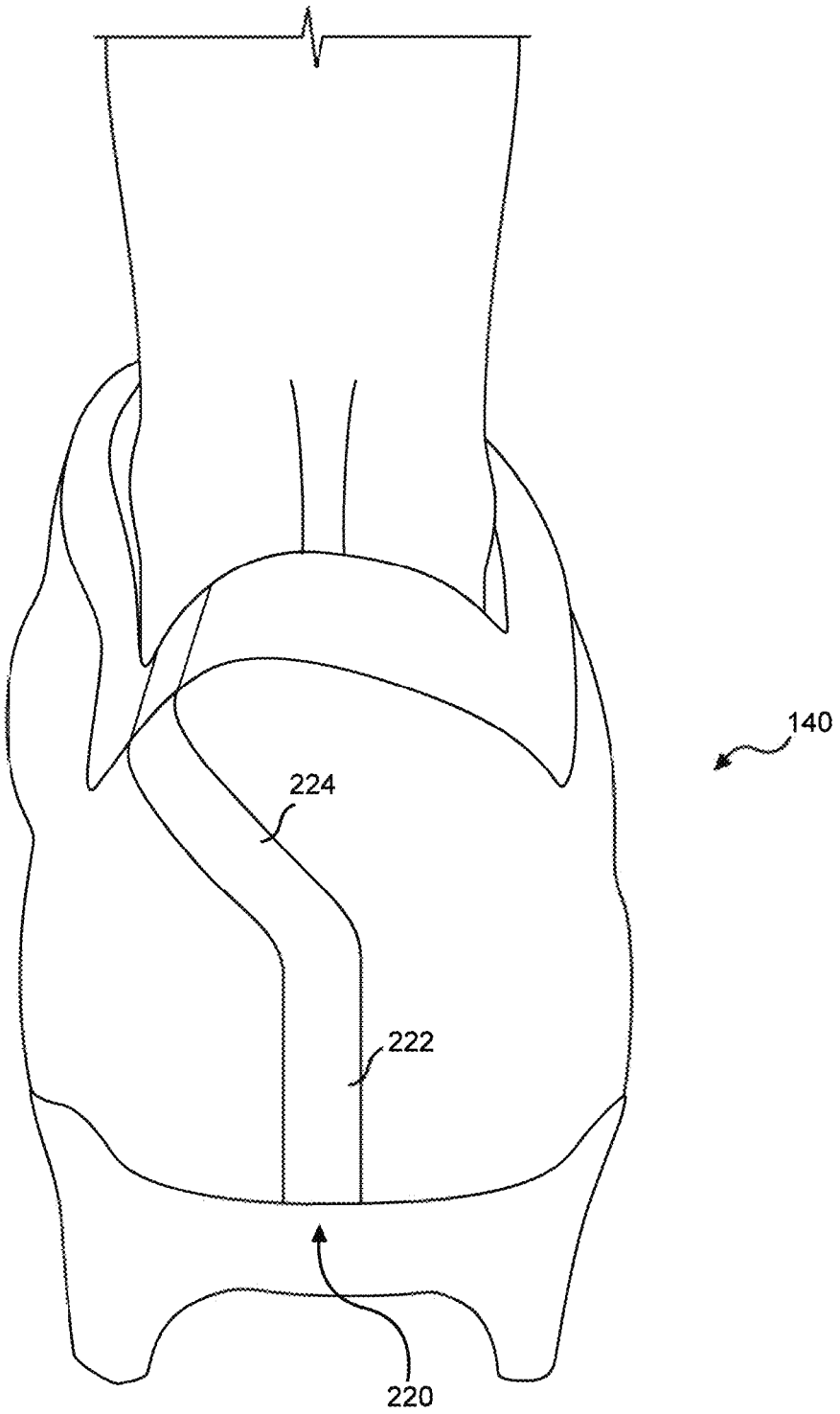
FIG. 3A illustrates a rear view of the exemplary article of footwear including a wearer and the heel seam with a medial bias, according to the exemplary embodiment of FIG. 2.
Figure 3B:
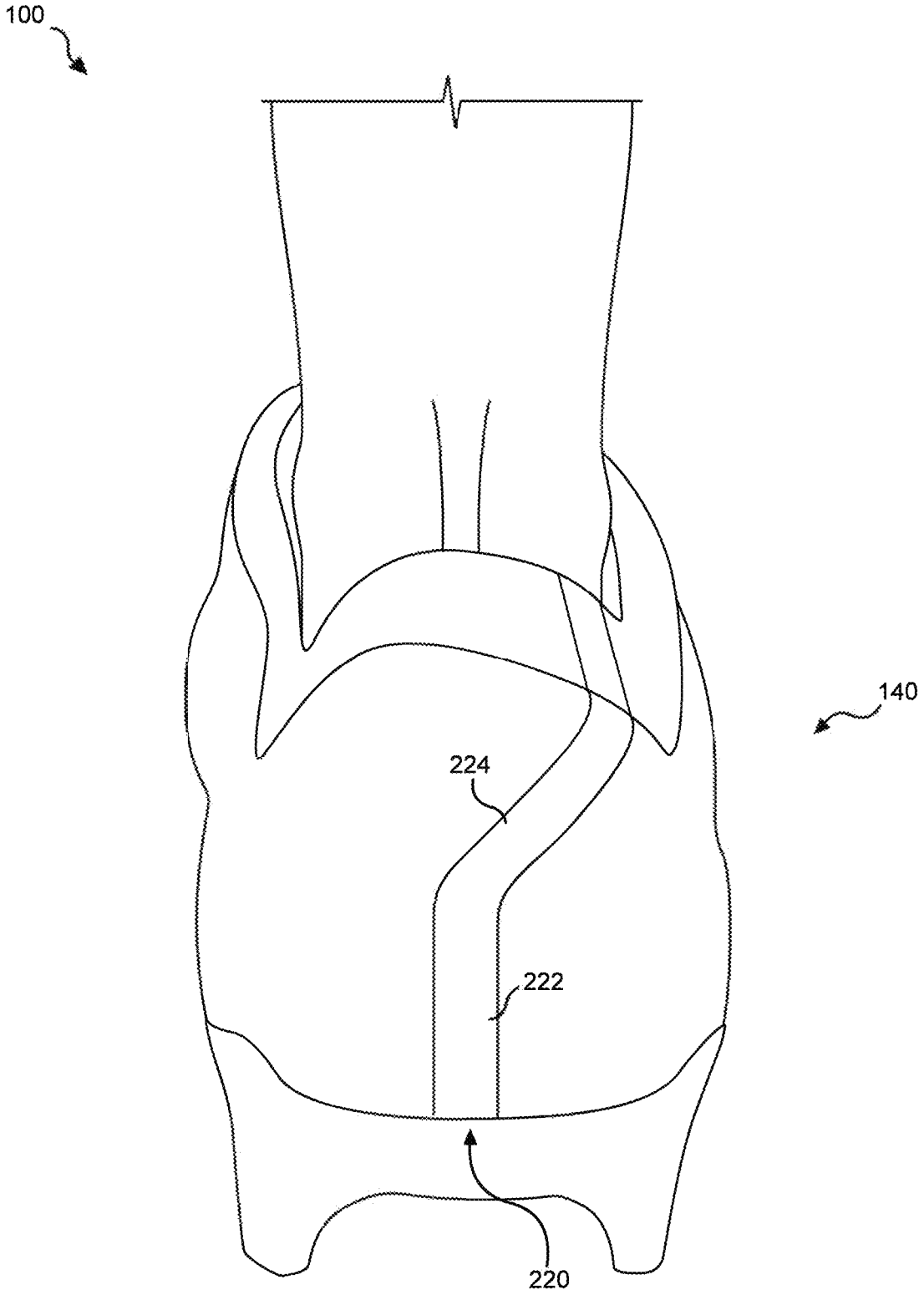
FIG. 3B illustrates a rear view of the exemplary article of footwear including a wearer and the heel seam with a lateral bias, according to the exemplary embodiment of FIG. 2.

In some example embodiments, upper portion 224 of asymmetric heel seam 220 may have a lateral bias, as depicted in FIG. 3B. The lateral bias of upper portion 224 may contour the lateral side of the foot of the wearer. As described with reference to FIG. 3A, lower portion 222 may be connected to or adjacent to midsole 132 and may be horizontally centered on heel portion 140. Upper portion 224 may be connected to lower portion 222 and have a lateral bias. Upper portion 224 may be positioned diagonally toward lateral side 106.

While described separately as lower portion 222 and upper portion 224, heel seam 220 may be a single piece of material that is stitched or glued to upper 102 to join medial side 104 and lateral side 106. Lower portion 222 and upper portion 224 may transition from symmetrical to asymmetrical with curved edges, as shown in FIG. 2, or sharp edges. In some example embodiments, heel seam 220 may include aesthetic features, such as design, logos, and/or color.

As shown in FIGS. 3A and 3B, asymmetric heel seam 220 may be positioned to contour the foot of the wearer. Conventional athletic shoes, such as soccer shoes, may include heel seams that are vertically aligned with the center of the back of the shoe, e.g., a symmetric heel seam with equal parts on the medial and lateral sides of the heel. This position of the heel seam may cause friction and discomfort for the wearer. A tighter fitting shoe may cause increased friction and discomfort in the heel and ankle of the wearer. However, as discussed throughout a tighter fitting shoe may be preferable for the wearer during athletic events, particularly in events such as soccer, where the wearer's shoe may be in contact with the ball, ground, other people, and therefore likely to be accidentally removed.

Asymmetrical heel seam 220 may contour the wearer's foot to create a tighter fit while avoiding the increased friction and discomfort. For example, the diagonal position of upper portion 224 connects to collar portion 150 in the gap between medial malleolus bone and Achilles tendon of the wearer's foot. With this arrangement, the asymmetrical bias to medial side 104 preferably provides a better fit that contributes to the finesse capabilities of a wearer of article 100. In an example embodiments, upper portion 224 may have a lateral bias, and connected to collar portion 150 on the lateral side of the foot of the wearer. The lateral bias of upper portion 224 may connect to collar portion 150 between the lateral malleolus bone and the Achilles tendon of the foot of the wearer.

Figure 4A:
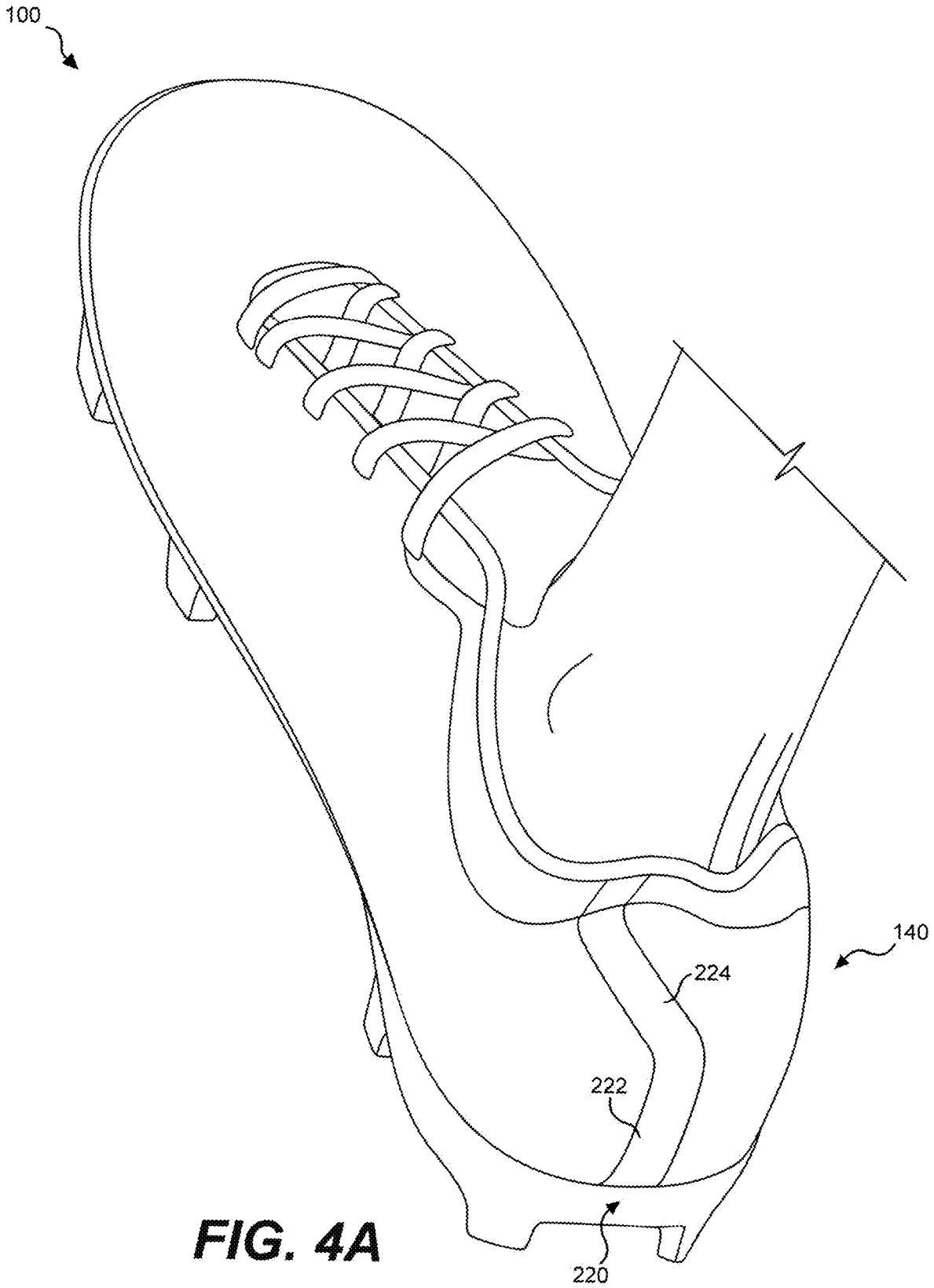
FIG. 4A illustrates an isometric view of a medial side the exemplary article of footwear being worn, according to the exemplary embodiment of FIG. 2.
Figure 4B:
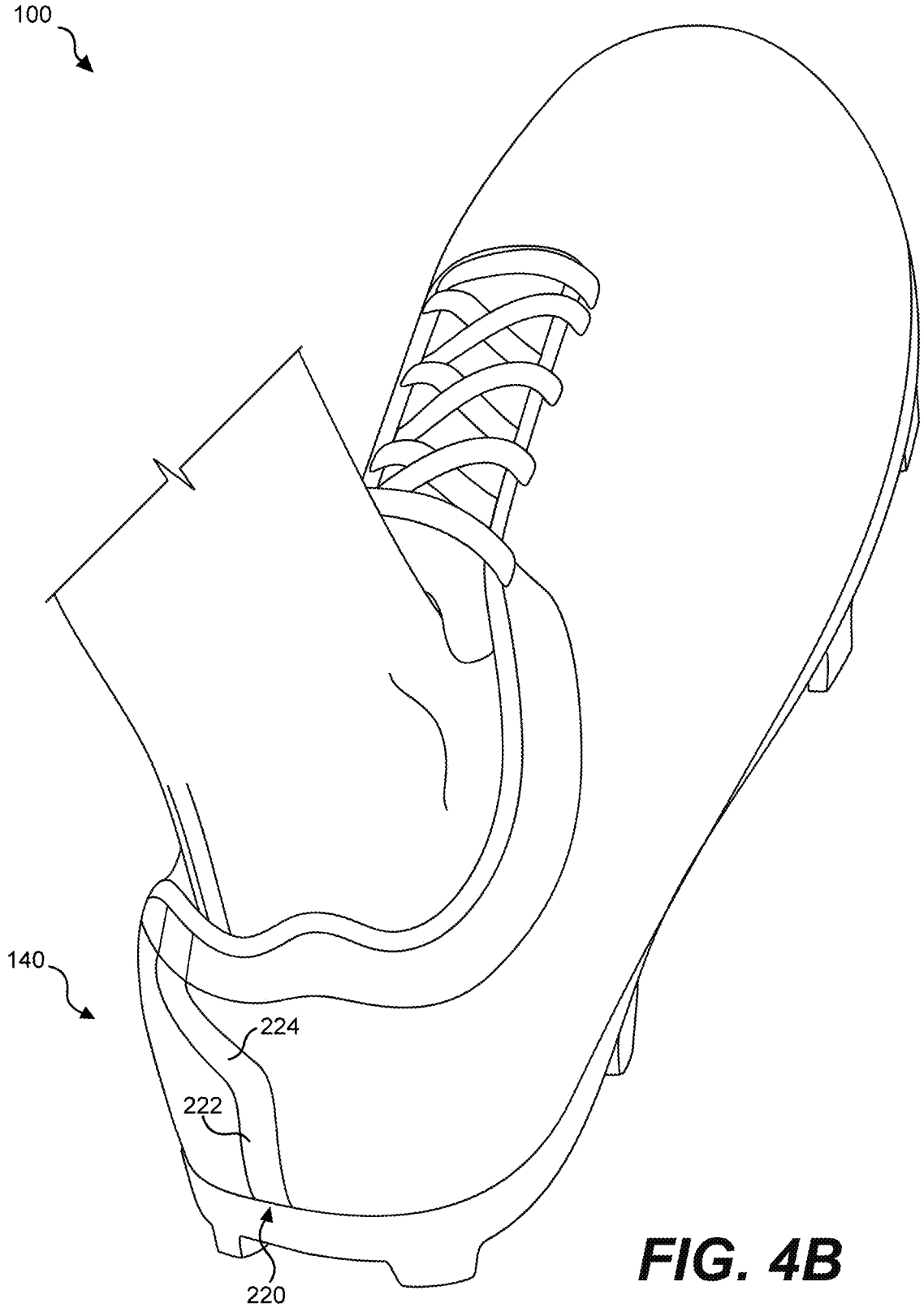
FIG. 4B illustrates a right isometric view of a lateral side of the exemplary article of footwear being worn, according to the exemplary embodiment of FIG. 2.

FIGS. 4A and 4B illustrate isometric views of asymmetric heel seam 220. Particularly, FIGS. 4A and 4B show the asymmetry of heel seam 220 on between medial side 104 and lateral side 106 of upper 102. Upper portion 224 of heel seam 220 does not align with the Achilles tendon on the back of the wearer's foot to avoid irritation during various athletic maneuvers. Upper portion 224 of heel seam 220 connects with topline 154 between the medial malleolus bone and Achilles tendon to prevent irritation to both parts of the ankle and foot. Additionally, the asymmetrical bias of upper portion 224 toward medial side 104 may allow the shoe to fit tighter in heel portion 140. This may provide the wearer with a more securely fitting shoe that also reduces irritation to the foot of the wearer.

In some example embodiments, topline 154 may have a medial topline edge 157 and lateral topline edge 158. Topline 154 may extend around opening 103 of article 100. In some embodiments, inner collar lining 152 and outer collar lining 156 may meet at topline 154. Topline 154 may be asymmetrical to correspond to heel seam 220. As shown in FIGS. 2-3 and 4A, lateral topline edge 158 may have consistent thickness on lateral side 106 of heel portion 140. Medial topline edge 157 may have varied thickness on medial side 104 to accommodate the asymmetrical bias of upper portion 224 toward medial side 104. For example, medial topline edge 157 may have the same thickness as lateral topline edge 158 at the horizontal center of heel portion 140. As medial topline edge 157 extends toward medial side 104, medial topline edge 157 may be thicker or thinner than lateral topline edge 158. The varied thickness of medial topline edge 157 may allow the heel portion 140 and/or collar portion 150 to contour the foot of the wearer. In some example embodiments, topline 154 may have consistent thickness on both medial side 104 and lateral side 106 of heel portion 140.

Figure 5:
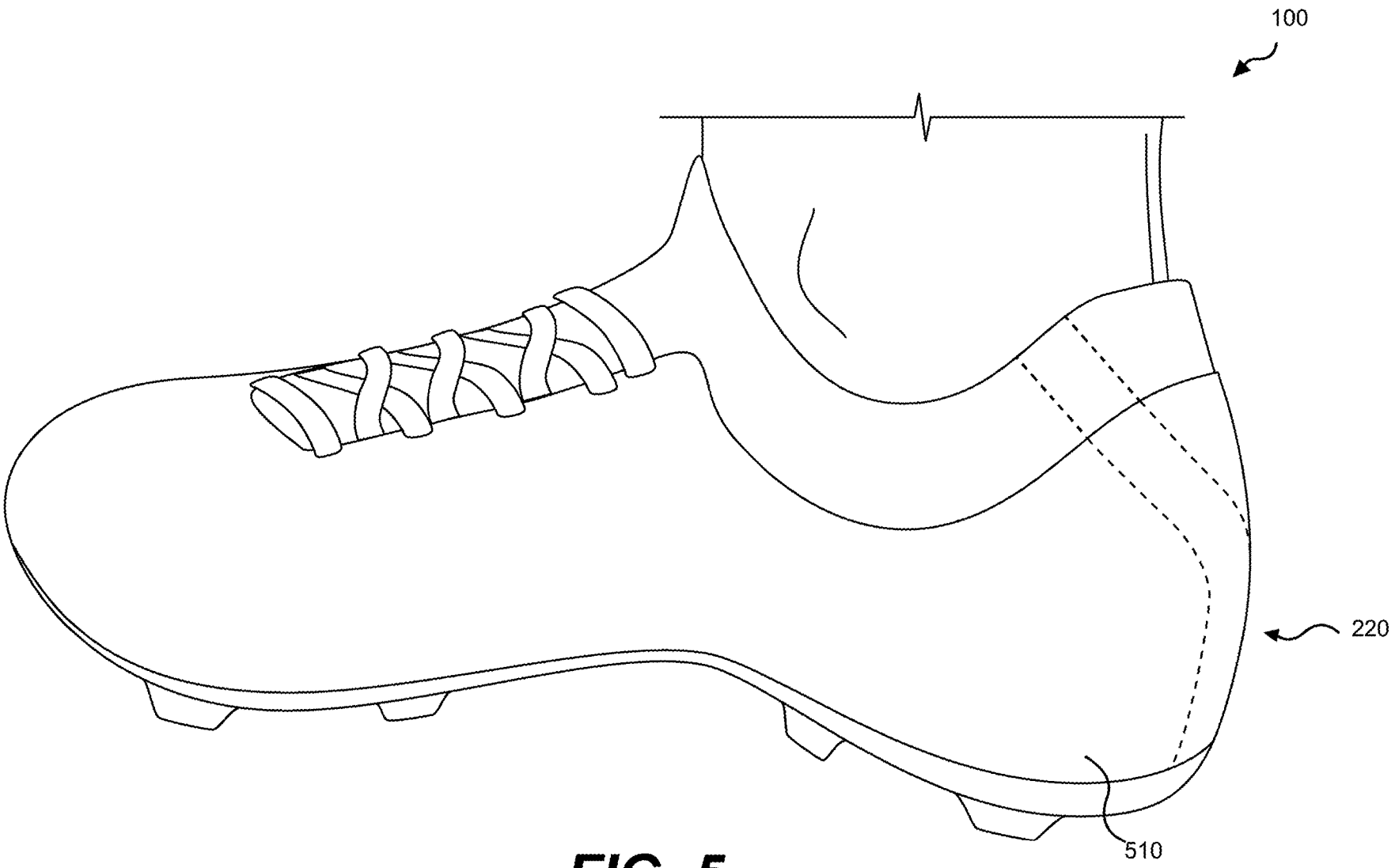
FIG. 5 illustrates a side view of the medial side of the exemplary article of footwear, according to the exemplary embodiment of FIG. 2.

In some example embodiments, heel seam 220 may not be visible. As shown, in FIG. 5, overlay 510 may cover heel seam 220. However, heel seam 220 may still have an asymmetrical bias toward medial side 104, even though it is not visible. As discussed above, upper 102 may include an arrangement of layers. The layers of upper 102 may each be joined using heel seam 220, with an asymmetrical bias toward medial side 104. Heel seam 220 having an asymmetrical bias toward medial side 104 at each layer of upper 102 may prevent irritation for the wearer as none of the seams may align with the Achilles tendon of the wearer. In some example embodiments, overlay 510 may be a thin material or film that provides some aesthetic features for the shoe, such as design, logos, or color. The thin layer of overlay 510 may not result in irritation to the wearer if not joined with heel seam 220, as the underlying, thicker layers are joined with asymmetrical heel seam 220. In some example embodiments, overlay 510 may be a single piece of material that does not incorporate a heel seam in heel portion 140.

Figure 6:
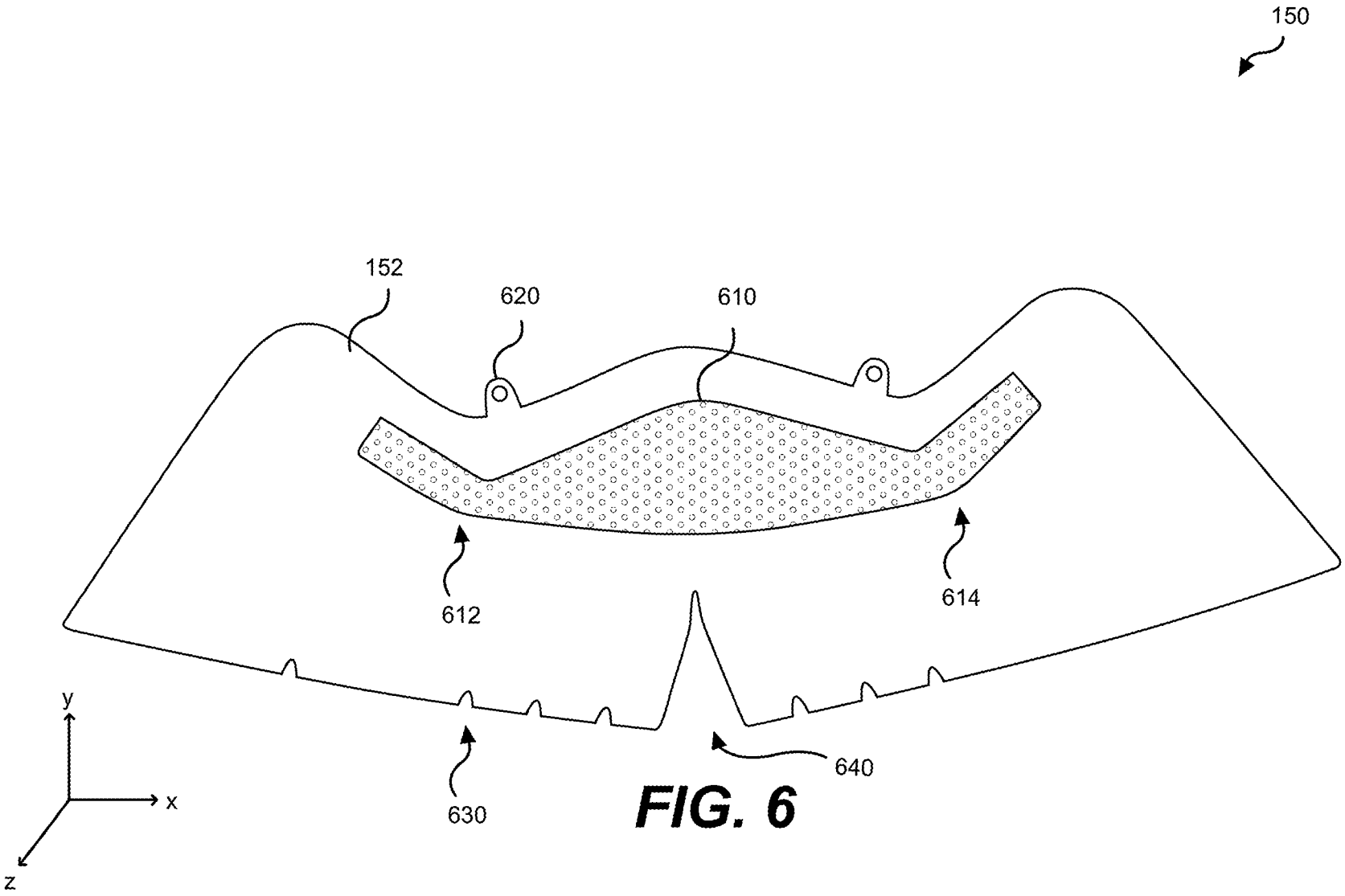
FIG. 6 illustrates a front view of a collar portion of the exemplary embodiment of the article of footwear of FIG. 1

Referring to FIG. 6, an article of footwear 100 may include an upper having a the collar portion 150 having an inner collar lining 152, collar foam 610, attachment points 620, collar cutouts 630, and collar split 640. Collar lining 152 may be coupled to the lining of the inside of the shoe and help couple the collar to upper 102. In some example embodiments, collar cutouts 630 may align with skiving in the outsole 1104 of sole structure 130. Both collar cutouts 630 and collar split 640 may allow collar portion 150 to smoothly couple to the inner portion of heel portion 140. Collar foam 610 may be coupled to collar lining 152 via stitching or glue. In some example embodiments, collar foam 610 may have a mesh overlay. For example, the overlay for collar foam 610 may be a woven polyester mesh (e.g., a single jersey textile mesh).

In some example embodiments, collar foam 610 may include medial collar foam 614 and lateral collar foam 612. Medial collar foam 614 and lateral collar foam 612 may be asymmetrical to accommodate the natural fit of the shoe for the wearer. In some example embodiments, "natural fit" may refer to shoe contouring the shape of the back of the, e.g., the heel having a wider base at the bottom of the foot and narrowing slightly following the Achilles tendon up the ankle. The asymmetry may have a medial bias that contours this narrowing by wrapping around the medial side of the heel. As discussed with reference to heel seam 220, the term "asymmetric" as used throughout this detailed description and in the claims refers to any arrangement of a component of the shoe that does not extend symmetrically over medial side 104 and the lateral side 106 of upper 102.

FIG. 6 includes a three dimensional, x, y, and z axis for reference. For the purposes of this disclosure, the x-direction refers to width, the y-direction refers to height, and the z-direction refers to depth or thickness. Medial collar foam 614 may have a greater height or width than lateral collar foam with reference to the y and x-directions of the reference axis. For example, with reference to in FIG. 6, medial collar foam 614 may be larger than lateral collar foam 612 with reference to the y-direction of the reference axis such that the height is greater. In some example embodiments, medial collar foam 614 may also or alternatively may be thicker than lateral collar foam 612 in the z-direction and/or x-direction of the reference axis. Medial collar foam 614 and lateral collar foam 612 may have symmetry in the z-direction and/or x-direction of the reference axis. The asymmetrical medial collar foam 614 and lateral collar foam 612 may be configured to accommodate the natural fit of the wearer, allowing the shoe to fit tighter, while increasing comfort for the wearer.

In some example embodiments, collar foam 610 may include one or more layers configured to increase foam rebound and slow recovery with dual density foam layers and thermoplastic polyurethane (TPU). The layered foam design may be configured to adapt to the heel geometry of the wearer and provide a natural, semi-custom fit. In some example embodiments, collar foam 610 may include three layers. Each of the three layers, e.g., top foam layer 710, middle layer 720, and/or bottom foam layer 730, may have a different thickness and/or material and be described with reference to FIGS. 7A-C, respectively. Further, each of the foam layers 710, 720, and/or 730 may have the same geometry and asymmetry as collar foam 610.

Figure 7A:
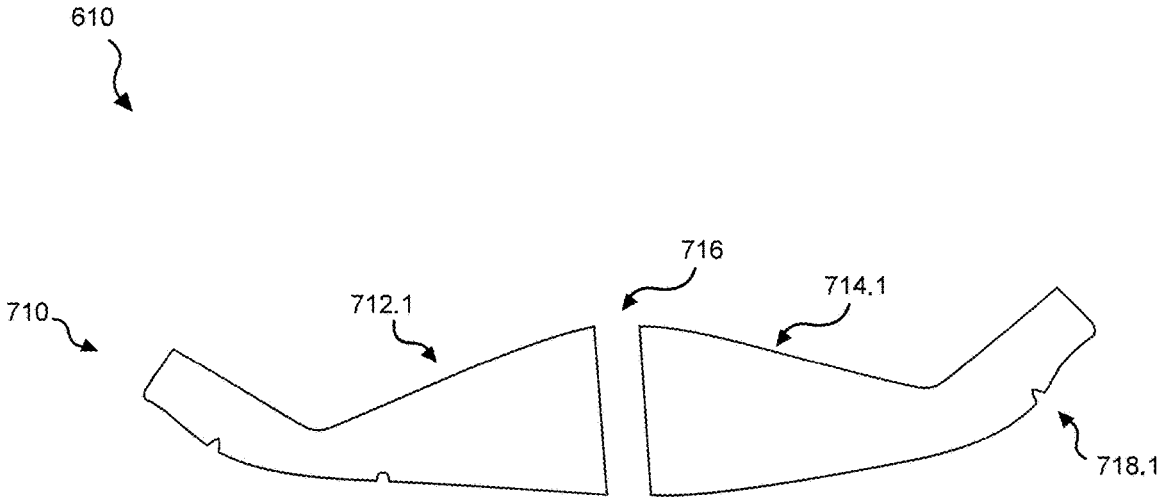
FIG. 7A illustrates a view of a top layer of a collar foam of the collar portion of FIG. 6.

FIG. 7A illustrates top foam layer 710 including lateral side 712.1, medial side 714.1, cutouts 718.1, and separation 716. Top foam layer 710 may be asymmetrical such that medial side 714.1 extends further in the y-direction than lateral side 712.1, as described with reference to FIG. 6. In some example embodiments, top foam layer 710 may consist of a low density polyurethane (PU) foam, e.g., a 2 millimeter PU foam with a hardness between 74-80 and density of 0.05-0.09 pounds per cubic foot (PCF). The PU foam may be a synthetic suede material with a knit base rather than a nonwoven base. The synthetic suede material allows the foam to hold its shape under pressure, rather than flatten a conventional PU foam materials might. The ability of the PU foam layers to hold shape contribute to the semi-custom fit of the shoe. Cutouts 718.1 may be configured to allow collar portion 150 to smoothly couple to the insole of article 100.

In some example embodiments, top foam layer 710 may also include separation 716. Lateral side 712.1 and medial side 714.1 may be vertically separated at the horizontal center of top foam layer 710. Separating lateral side 712.1 and medial side 714.1 may prevent creasing when inner collar lining 152 is coupled with the insole of article 100. Separation 716 may be form by first cutting a vertical line in top foam layer 710 at the horizontal center. The line may be cut to create a hole in the center of top foam layer 710 and then fully separate lateral side 712.1 and medial side 714.1.

Figure 7B:
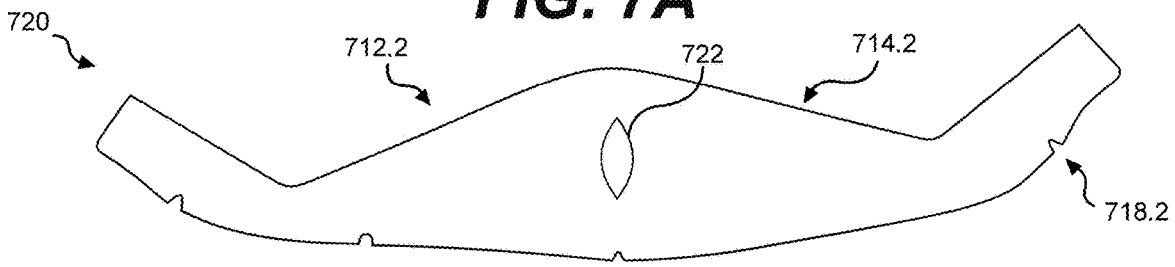
FIG. 7B illustrates a view of a middle layer of the collar foam of the collar portion of FIG. 6.

FIG. 7B illustrates middle layer 720 including lateral side 712.2, medial side 714.2, and cutouts 718.2. Middle layer 720 may be asymmetrical such that medial side 714.2 extends further in the y-direction than lateral side 712.2, as described with reference to FIG. 6. In some example embodiments, middle foam layer 720 may consist of a thermoplastic polyurethane foam layer (TPU). The TPU material may be configured to melt or activate between 60-75 degrees Celsius with a hardness of 62-77 and density of 0.08-.12 PCF. The melting point of the TPU material of middle layer 720 allows collar foam 610 to hold its shape during wear, which may put increased pressure on heel portion 140. Bottom foam layer 730 and top foam layer 710 provide cushioning to create the semi-custom fit of heel portion 140 and collar portion 150. Cutouts 718.2 may be configured to allow collar portion 150 to smoothly couple to the insole of article 100. In some example embodiments, middle layer 720 may include hole 722. Similar to separation 716, hole 722 may allow the layers of collar foam 610 to be laminates and curve around opening 103 and/or heel portion 140 without creasing. Reducing the creasing of collar portion 150 may allow for a tighter fit for the wearer.

Figure 7C:
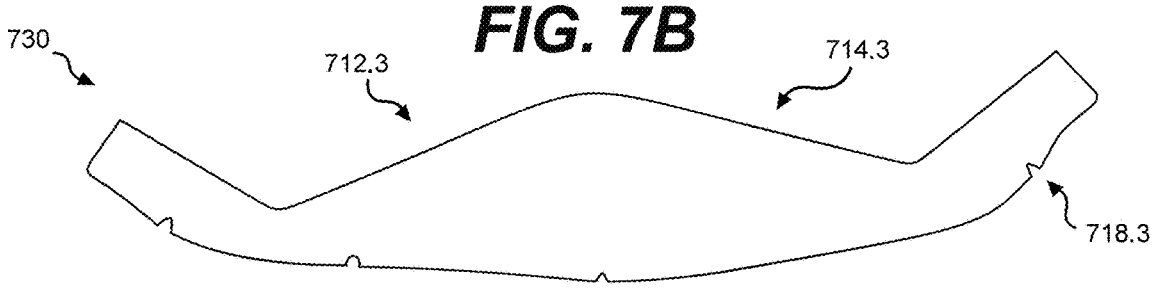
FIG. 7C illustrates a view of a bottom layer of the collar foam of the collar portion of FIG. 6.

FIG. 7C illustrates bottom foam layer 730 including lateral side 712.3, medial side 714.3, and cutouts 718.3. Bottom foam layer 730 may be asymmetrical such that medial side 714.3 extends further in the y-direction than lateral side 712.3, as described with reference to FIG. 6. Bottom foam layer 730 may be made of a high density polyurethane (PU) foam, e.g., a 4 millimeter PU foam with a hardness between 74-80 and density of 0.05-0.09 PCF. The PU foam may be a synthetic suede material with a knit base rather than a nonwoven base. The synthetic suede material allows the foam to hold its shape under pressure, rather than flatten a conventional PU foam materials might. The ability of the PU foam layers to hold shape contribute to the semi-custom fit of the shoe. Cutouts 718.3 may be configured to allow collar portion 150 to smoothly couple to the insole of article 100.

Figure 8A:
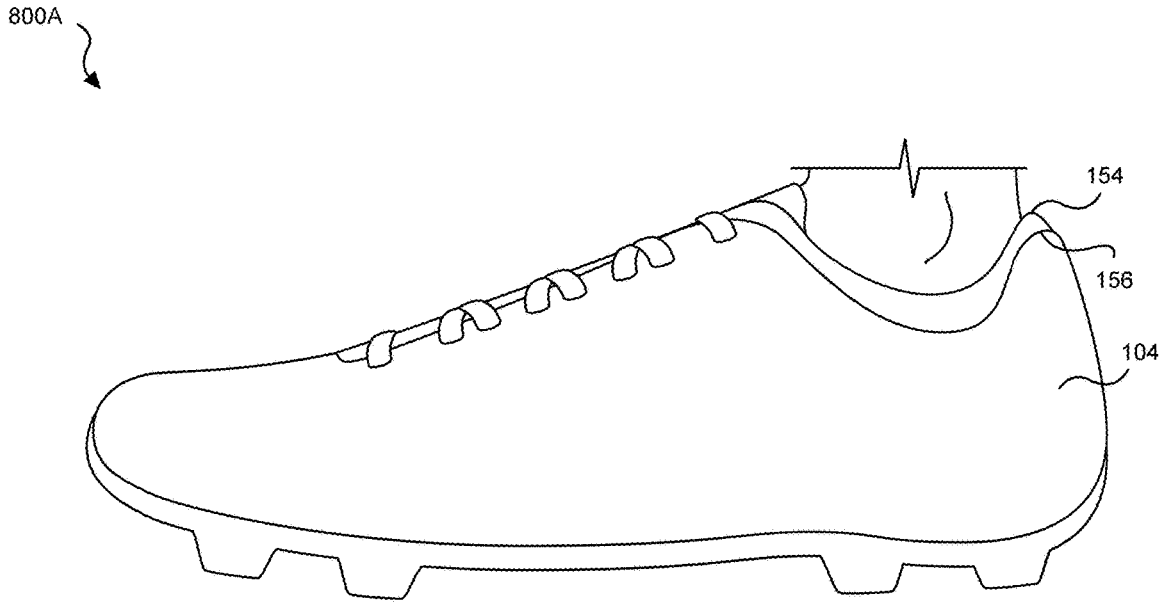
FIG. 8A illustrates a lateral side view of the collar portion of the exemplary embodiment of the article of footwear of FIG. 1.
Figure 8B:
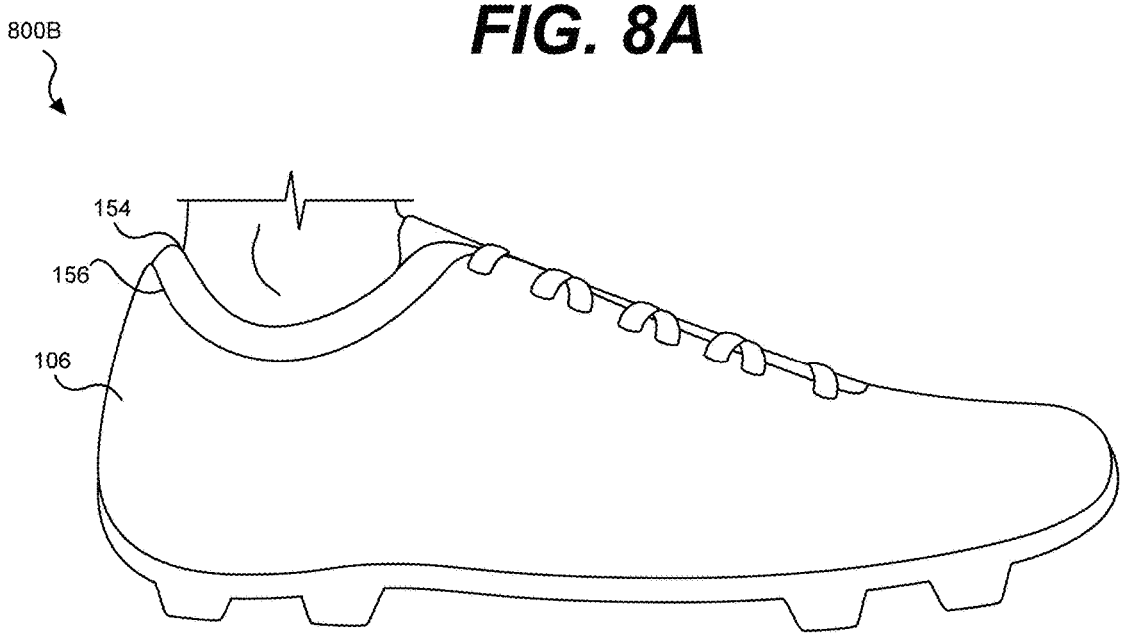
FIG. 8B illustrates a medial side view of the collar portion of the exemplary embodiment of the article of footwear of FIG. 1.
Figure 8C:
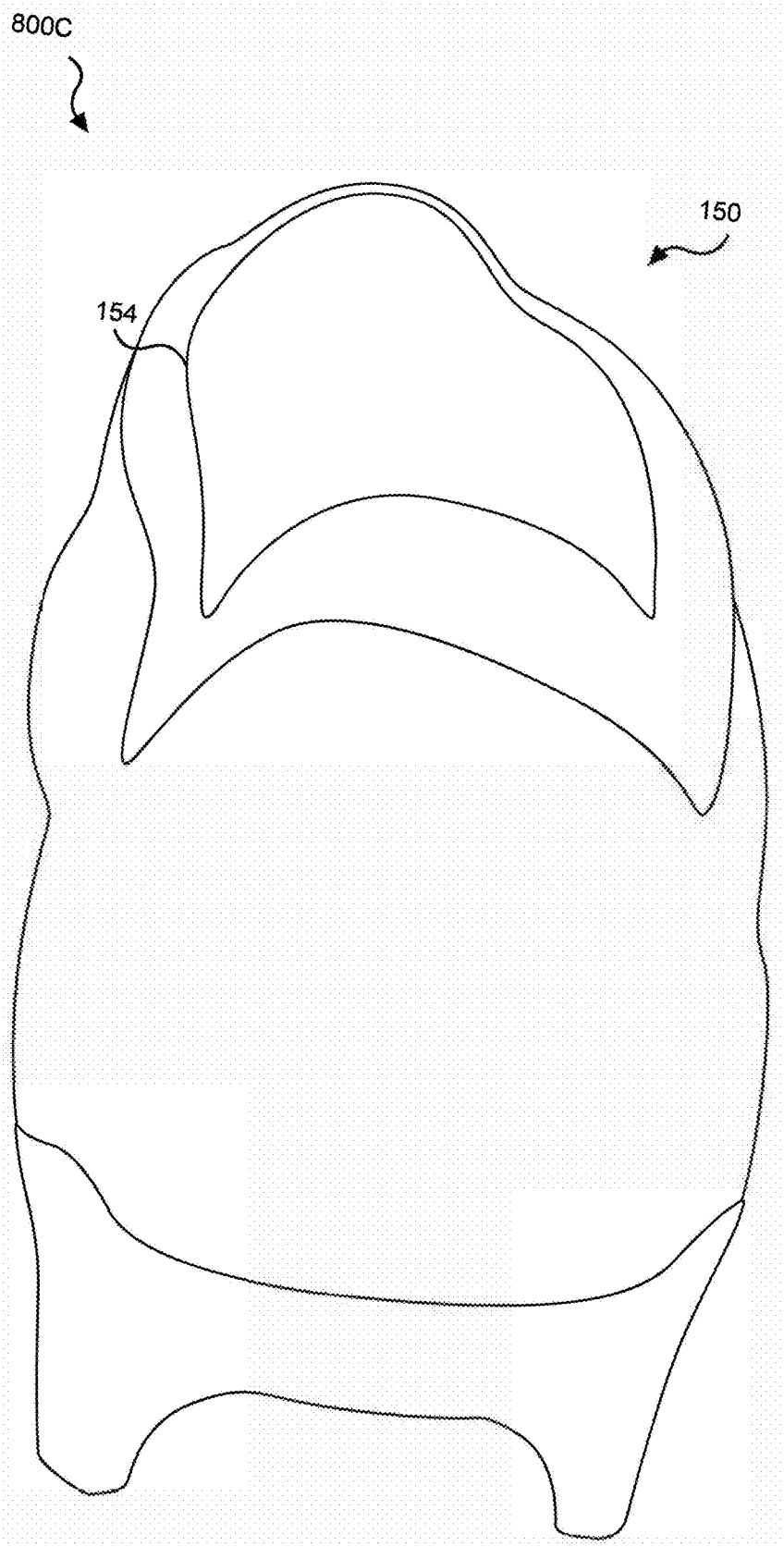
FIG. 8C illustrates a rear view of the collar portion of the exemplary embodiment of the article of footwear of FIG. 1.

In addition to the asymmetry of collar foam 610, outer collar lining 156 may have asymmetry with viewing collar portion 150 from the medial, lateral, and heel portions as shown in FIGS. 8A-C, respectively. The orientation of inner collar lining 152 within the shoe may result in asymmetry in outer collar lining 156. For example, outer collar lining 156 may dip below the medial malleolus bone of the wearer, as show in FIG. 8B. The asymmetry of collar portion 150 is also shown in FIG. 80, when viewing heel portion 140 from the rear. Medial collar foam 612 is configured to provide additional cushion around the medial malleolus bone and provide a better fit for the wearer. As a results the medial side of outer collar lining 156 may dip below the medial malleolus bone and asymmetrical compared to the lateral side of outer collar lining 156. Similarly, heel seam 220 may have an asymmetrical bias toward medial side 104. These features may result in asymmetry of outer collar lining 156.

Figure 9:
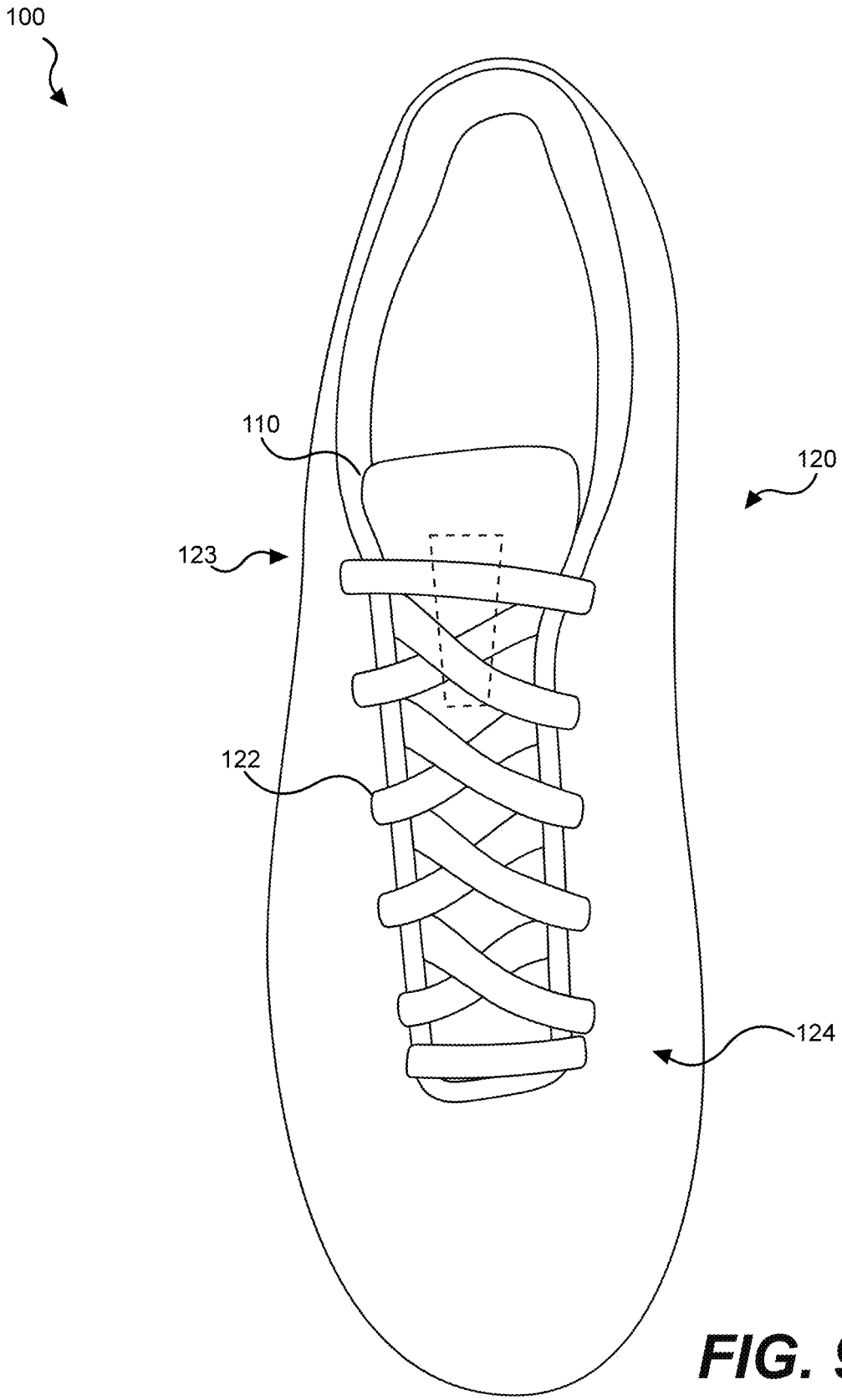
FIG. 9 illustrates a top view of the exemplary embodiment of the article of footwear of FIG. 1 including a fastening system and tongue.

FIG. 9 illustrates a top view of the exemplary embodiment of the article of footwear of FIG. 1 including a fastening system and tongue. Tongue 110 may include a tongue foam 910 and fastening system 120. Fastening system 120 may be implemented as lacing system 120 and include laces 122. Lacing system 120 configured with first end portion 123 and second end portion 124. Lacing system 120 may be configured to be tightened to secure a wearer's foot in upper 102. Lacing system 120 may be tightened such that the wearer's foot is secure, but first end portion 123 may irritate that top of the wearer's foot. For example, when laces 122 are tightened and tied at first end portion 123 the laces, knot, or a combination may rub against tongue 110 and irritate the wearer's foot. Further, during many athletic activities, the wearer may move their ankle causing tongue 110 and first end portion 123 to rub against the top of wearer's foot.

In some example embodiments, article 100 may include tongue foam 910 to prevent the irritation caused by lacing system 120. Tongue foam 910 may be disposed on the underside of tongue 110, as shown in FIG. 9. Tongue foam 910 may be couple to tongue 110 anywhere along tongue 110 and lacing system 120 may cause irritation to the wearer's foot. For example, to prevent irritation to the wearer's foot at first end portion 123, tongue foam 910 may be coupled to tongue 110 at first end portion 123. Tongue foam 910 may provide a cushioned buffer between laces 122 and tongue 110 with the top of the wearer's foot.

In some example embodiments, fastening system 120 may be a system other than a lacing system, such as a zipper mechanism or hook and loop. Fastening system 120 may also fasten in a location other than first end portion 123, such as second end portion 124 or with a bias toward medial side 104 or lateral side 106. Tongue foam 910 may be coupled to tongue 110 where irritation due to fastening system 120 may occur. In some example embodiments, tongue 110 may include multiple instances of tongue foam 910 where fastening system 120 causes multiple points of irritation.

Figure 10:
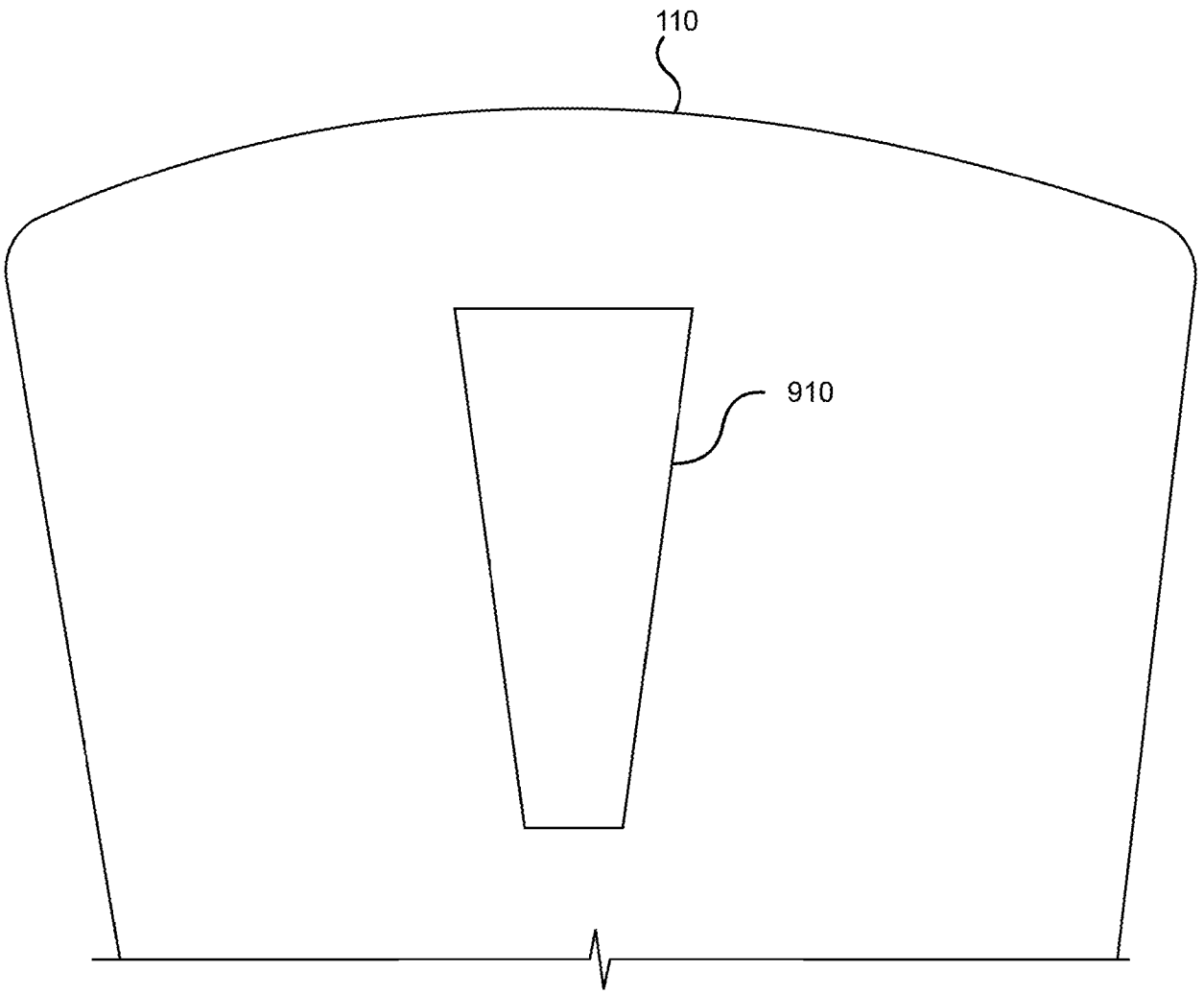
FIG. 10 illustrates a partial view of the tongue of the exemplary embodiment of the article of footwear of FIG. 9.

FIG. 10 illustrates a partial view of tongue foam 910 coupled to tongue 110. Tongue foam 910 may be coupled to tongue 110 on the underside of tongue 110 to adjust the softness of tongue 110. Tongue foam 910 may create a barrier between tongue 110 and the wearer's foot. In some example embodiments, tongue foam 910 may be tapered. For example, tongue foam 910 may be wider nearer to first end portion 123 and taper to a smaller width near second end portion 124. In some example embodiments, tongue foam 910 may have a uniform thickness, e.g., 6 mm. In other example embodiments, the thickness of tongue foam 910 may taper corresponding to the tapered shape, e.g., 6 mm at first end portion 123 and 2 mm at second end portion 124. The thickness of tongue foam 910 may be adjusted to accommodate the design of tongue 110 and fastening system 120. This may allow tongue foam 910 to provide cushion between tongue 110 and the wearer's foot where fastening system 120 may be most likely to cause irritation, e.g., where the laces are tied at first end portion 123, without adding additional weight to article 100. Tongue foam 910 may take a different size and/or shape, i.e., any regular or irregular shape, to accommodate tongue 110 and fastening system 120 of article 100.

Some conventional embodiments may add a foam layer to the tongue, however these foam layers may be concentric and cover the entire or a majority of the tongue. Tongue foam 910 may be configured to increase the softness of tongue 110 and provide a barrier for the wearer's foot, without increasing the weight of the shoe. Additionally, in some embodiments, article 100 may be a soccer cleat designed for high performance play. As a result, a tight fit is important to the performance of the shoe. Traditional large thick foam pieces impede the ability of the shoe to have a tight fit for the wearer.

Tongue foam 910 may be consist of a polyurethane (PU) foam. In some embodiments, the PU foam of tongue foam 910 may partially consist of recycled thermoplastic polyurethane (TPU). The PU foam of tongue foam 910 may be configured to stretch with the knit construction of tongue 110 without decoupling from tongue 110 during wear. Additionally, the PU foam may hold its shape without flattening under pressure of fastening system 120 and increased heat of the wear's foot and/or article 100 during wear and activity. Tongue foam 910 may be coupled to tongue 110 using a thin film with a low melting point, e.g., a hot melt adhesive (HMA) of 95 degrees Celsius. The film may contribute to the ability of tongue foam 910 to bond and stretch with tongue 110 without delaminating. In some embodiments, a vacuum forming process may be used to apply the HMA think film to tongue 110 to attach tongue foam 910.

Figure 11A:
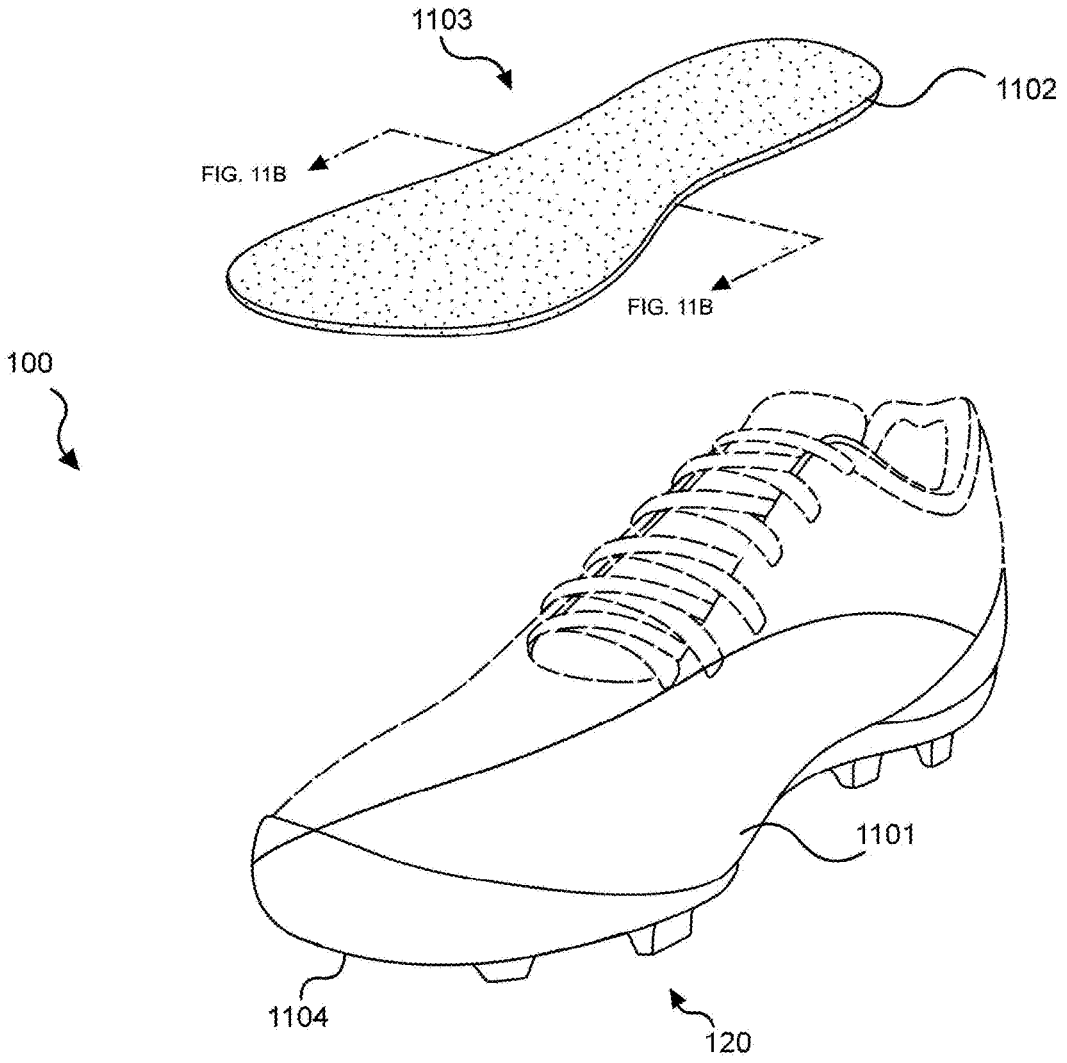
FIG. 11A illustrates an isometric view of a sole structure of the exemplary embodiment of the article of footwear of FIG. 1.
Figure 11B:
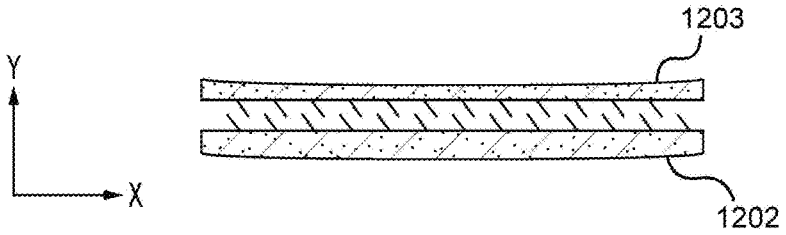
FIG. 11B illustrates an isometric view of a sockliner of the sole structure of FIG. 11A.

FIGS. 11A-11B illustrates an isometric view of a sockliner configured for use in the exemplary embodiment of the article of footwear of FIG. 1. In some example embodiments, sockliner 1102 is configured to be inserted in opening 103 of article 100. In some embodiments, sockliner 1102 may be used in conjunction with or in place of insole 1101. Sockliner 1102 may be disposed adjacent to the foot of the wearer inserted within article 100 via opening 103.

The top surface of sockliner 1102 is preferably configured to contact the foot of the wearer within article 100. Likewise, the bottom surface of sockliner 1102 may be associated with the top of insole 1101 or outsole 1104. FIG. 11B illustrates a cross-sectional view of the top of sockliner 1102 and the bottom of the foot of a wearer. Sockliner 1102 may be configured to increase friction between the bottom of the sock of the wearer 1203 and sockliner 1102. The cross-sectional view illustrates how forward facing hooks and/or spines 1103 of the textured material of sockliner 1102 may attach to the material of the sock of the wearer 1203. Forward facing hooks and/or spines 1103 of sockliner 1102 may prevent the sock and foot of the wearer from easily moving backward while inserted into a fastened shoe.

Figure 12:
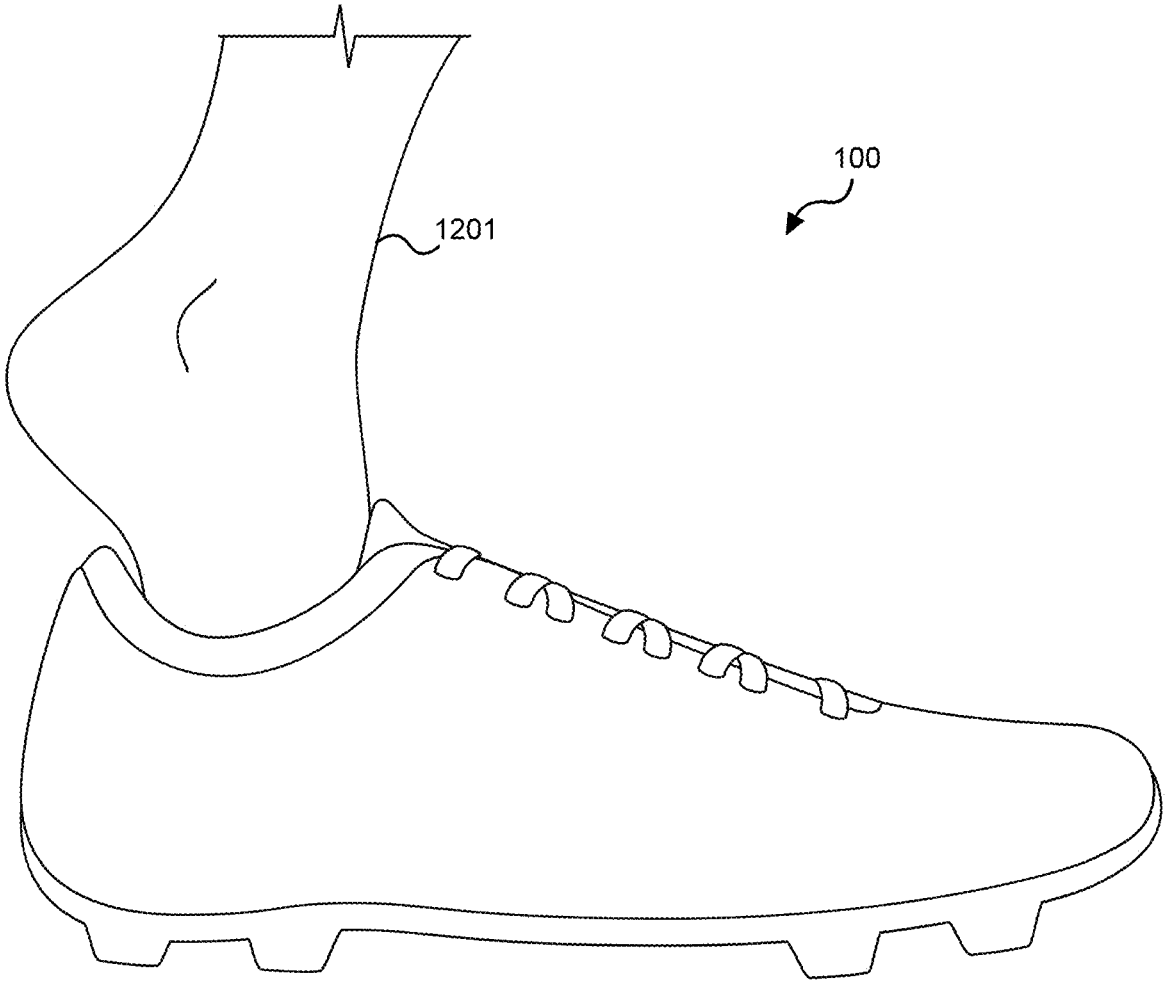
FIG. 12 illustrates a demonstration of the foot of the wearer being inserted or removed from an opening of the exemplary embodiment of the article of footwear of FIG. 1.

As demonstrated in FIG. 12, sockliner 1102 may consist of a material including a rough texture that increases friction when the foot of the wearer 1202 is moving backward within the shoe, e.g., removing the foot from the shoe. The forward angled hooks and/or spines 1103 that allow the foot of the wearer to easily be insert into the shoe, but catch the texture of the wearer's sock to increase friction when the foot is being removed. This texture may be particularly advantageous in athletic shoes, such as soccer shoes, during activities like running or kicking in which the foot may be easily slipped out of the shoe. As described throughout, article 100 is configured to provide a semi-custom, tight-fitting shoe that increases the security of the foot in the shoe and comfort for the wearer.

Accidental or unexpectedly having the foot removed from the shoe may increase the likelihood for injury and decrease performance for the wearer during athletic activities. Sockliner 1102 may provide additional security for the wearer while the foot of the wearer is fastened into the shoe using fastening system 120. When the wearer unfastens the foot from the shoe, the user can easily remove their foot. While the foot is fastened into the shoe, the tight fitting design of the shoe causes the bottom of the foot of the wearer 1203 to press into sockliner 1022. The pressure and forward direction of the texture of sockliner 1102 increase the friction during wear, it is more difficult to remove the foot from the shoe when the foot is not intended to be removed.

Figure 13:
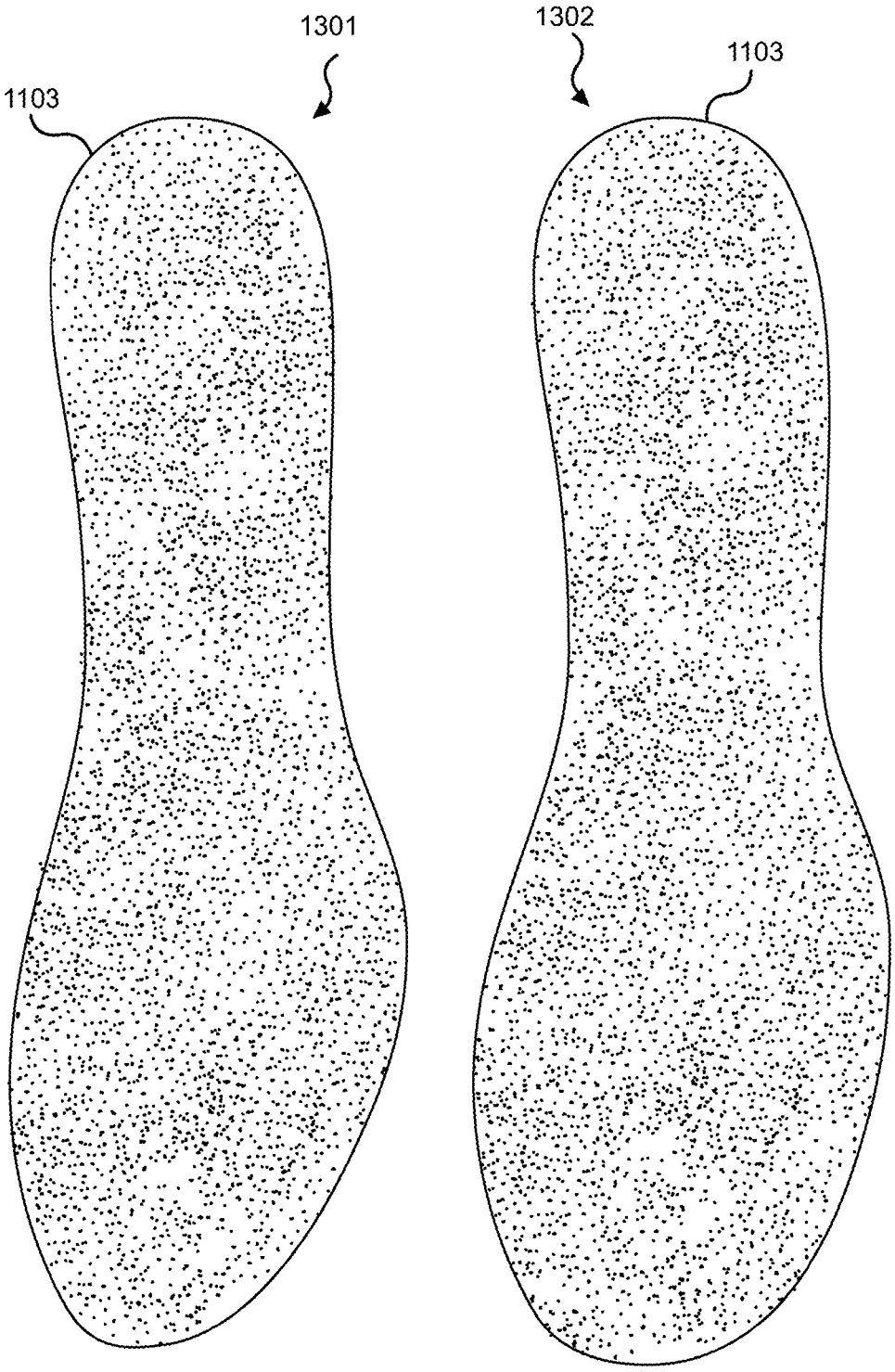
FIG. 13 illustrates a top and bottom view of the sockliner of FIGS. 11A-11B.

FIG. 13 illustrates a top and bottom view of sockliner 1102. In some example embodiments, sockliner 1102 may include a top surface 1301 and bottom surface 1302. Both top surface 1301 and bottom surface 1302 may consist of the same textured textile material with hooks and/or spines 1103. Similar to the description of the textured material on top surface 1301 with reference to FIGS. 11A-11B and 12, the textured material may increase friction between bottom surface 1302 and the top of insole 1101. The uniform texture of bottom surface 1302 may be configured to increase the stability of sockliner 1102 within article 100. Hooks and/or spines 1103 of the textured textile material may be backward facing. For example, hooks and/or spines 1103 may extend from bottom surface 1302 of sockliner 1102 toward the back of article 100, e.g., second end portion 124 and/or heel portion 140. This may impede sockliner 1102 from moving backward in article 100 by catching on insole 1101. In some embodiments, sockliner 1102 may prevent backward movement of the foot of the wearer in the shoe while in other embodiments, the backwards movement may be reduced, depending on the type of sock or covering on the foot of the wearer. In some exemplary embodiments, hooks and/or spines 1103 of the textured textile material on bottom surface 1302 may extend forward, similar to hooks and/or spines 1103 on top surface 1301.

Figure 14:
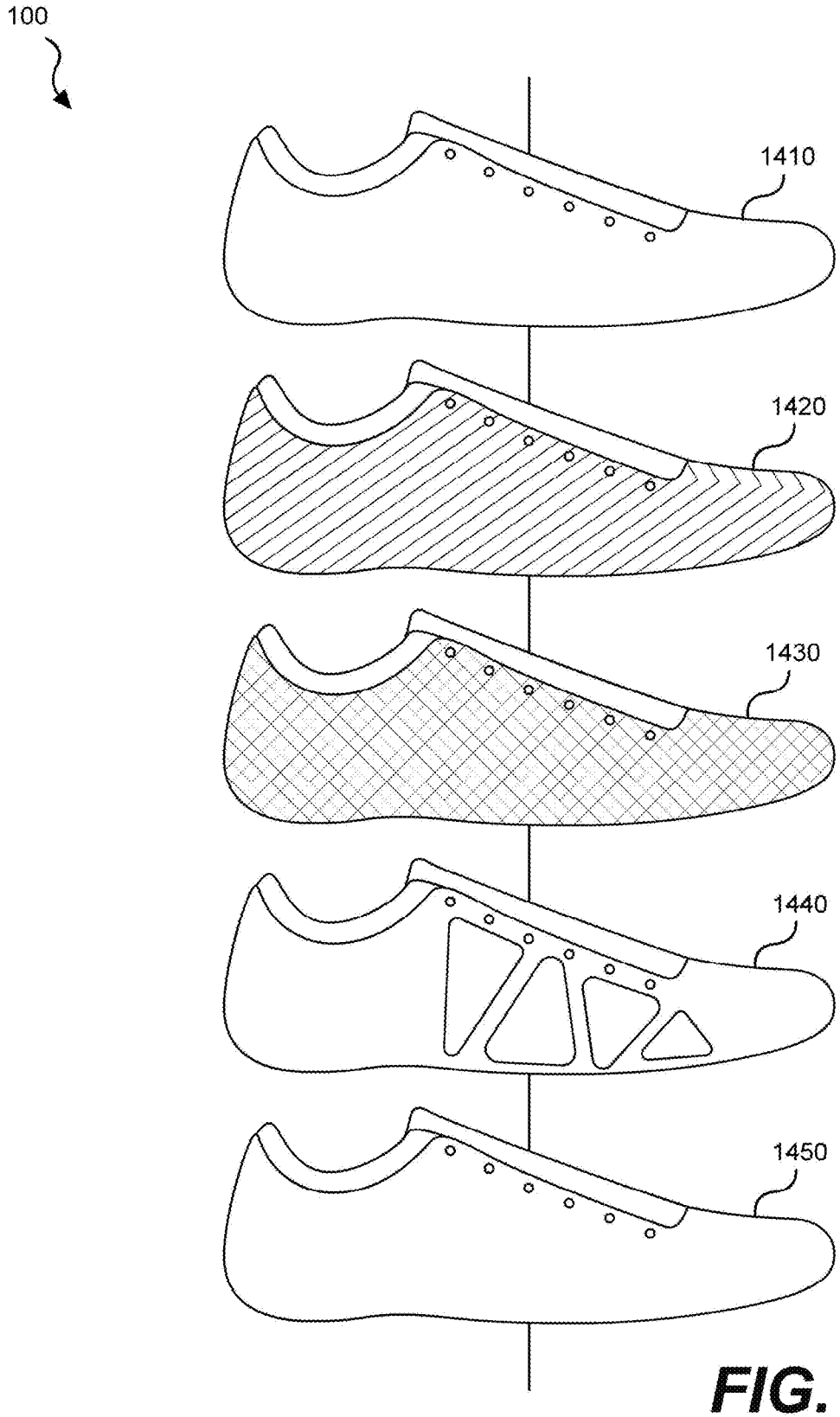
FIG. 14 illustrates an arrangement of layers of an upper of the exemplary embodiment of the article of footwear of FIG. 1.

FIG. 14 illustrates the arrangements of layers of the upper in the exemplary embodiments of the article of footwear. As discussed throughout, upper 102 may include an arrangement of layers. In some example embodiments, the arrangement of layers may include vamp overlay 1410, vamp 1420, vamp lining 1430, vamp reinforcer 1440, and base vamp lining 1450. The layers of upper 102 may be couple by means of stitching, glue, heat melting adhesive, molding, or any other suitable method of coupled layered textiles. Additionally, multiple means of coupling may be used between layers, for example, vamp overlay 1410 and vamp 1420 may be coupled using a heat melting adhesive while all five of the layers may be sewn together after each layer has been coupled.

In some example embodiments, vamp overlay 1410 may be configured to graphics, logos, or other aesthetic elements of upper 102 of article 100. Vamp overlay 1410 may also provide protecting to vamp 1420 and vamp reinforcer 1440. Vamp overlay 1410 may be formed from a mesh or other type of textile material. In some example embodiments, vamp overlay 1410 may be formed of a continuous single elements, e.g., an element cut from a larger sheet of textile material. In addition to the reduction of weight, the textile material may also provide increased grip and stretch.

Vamp 1420 may be configured to provide grip and stretch to upper 102. Vamp 1420 may be formed of a light weight TPU material. In some embodiments, vamp 1420 may be the outermost layer of article 100 such that it makes contact with the playing surface and/or equipment during athletic play. The material of vamp 1420 may have increased stretch and tackiness or grip which may be advantageous during athletic activities such as soccer. Traditionally, a TPU would have a low enough melting point that it would activate and not be a good candidate for use in a high friction area of the shoe, such as vamp 1420. However, the TPU material of vamp 1420 has a high melting point e.g., at or above 110 degrees Celsius. Due to the uncharacteristically high melting point of the TPU material, it may not activate (e.g., melt or soften) from friction during athletic play and deform. This material provides a level of tackiness or grip, e.g., increase friction with the material of a soccer ball or other athletic ball, while still maintaining the shape of vamp 1420 and upper 102.

The increased grip and stretch of the fabric of vamp 1420 may provide an advantage during athletic activities such as soccer, which require the wearer to use their shoe to interact with the ball. Increased grip with interacting with the ball may provide more control of the ball to the wearer. The stretch of article 100 may allow the wearer to perform athletic maneuvers without being hindered by the structure of the shoe. As shown in FIG. 14, the material of vamp overlay 1410 may have a chevron pattern centered between medial side 104 and lateral side 106 of upper 102.

In some example embodiments, the material may perform according to Table 1 when tested for elongation to measure stretch. The left column of Table 1 describes the area of elongation testing of the shoe. In some embodiments, the thermoplastic polyurethane (TPU) material described in Table 1 may be used for vamp overlay 1410 and/or vamp 1420.

TABLE 1

Elongation Testing of Vamp 1420

| Testing Area of Upper | Grip Distance (mm) | Max Load (kgf) | Elongation at 25% of Max Load (%) | Elongation at 50% of Max Load (%) | Elongation at 75% of Max Load (%) | Elongation at 100% of Max Load (%) |
|---|---|---|---|---|---|---|
| Medial Quarter | 30 | 40 | 4.36 | 7.57 | 11.42 | 15.74 |
| Lateral Quarter | 30 | 40 | 3.21 | 6.31 | 9.95 | 13.89 |
| Vamp Anterior-Posterior | 40 | 40 | 2.65 | 4.71 | 6.57 | 8.31 |
| Vamp Medial-Lateral | 100 | 40 | 3.09 | 5.52 | 7.58 | 9.61 |

Vamp lining 1430 may be configured to support vamp 1420 and vamp reinforcer 1440. Vamp lining 1430 may be formed of a polyester mesh textile material. In some example embodiments, vamp lining reinforcer may include two layers. A first layer may be used for reinforcement of vamp 1420 and a second layer may be used for reinforcement of vamp reinforcer 1440. The textile material of vamp 1420 and vamp reinforcer 1440 may be configured to reduce the weight of upper 102, increase stretch, and improve malleability of article 100. Vamp lining 1430 may provide a layer of structure for upper 102 to support vamp 1420 and vamp reinforcer 1440. This may increase the lifespan of article 100 and prevent damage to the shoe.

Vamp reinforcer 1440 may configured to provide additional support and structure to upper 102. Vamp reinforcer 1440 may be formed of a synthetic suede nonwoven textile material. The textile material of vamp reinforcer 1440 may be thinner than conventional upper materials, allowing the weight of article 100 to be reduced. For example, in some embodiments, the combination of lightweight materials in the layered upper 102 may reduce the weight of article 100 by at least 15 grams. The thinner, light weight textile material used for vamp reinforcer 1440 may allow wearer to reduce the amount of time required to break in the shoe, e.g., achieve a desired level of comfort for the particular foot of the wearer. Vamp reinforcer 1440 may include cutouts to increase allow airflow in and out of the shoe to reduce the internal heat. Additionally, the cutouts may reduce the weight of upper 102 and article 100 which still providing structure without stretch to the shoe, to accommodate the higher stretch and tacky material of vamp 1420 and/or vamp overlay 1410.

Base vamp lining 1450 may be configured to be an additional layer of support for vamp reinforcer 1440, as described with reference to vamp lining 1430. In some example embodiments, base vamp lining 1450 may be configured to attach upper 102 to sole structure 130, collar portion 150, and/or tongue 110.

Figure 15:
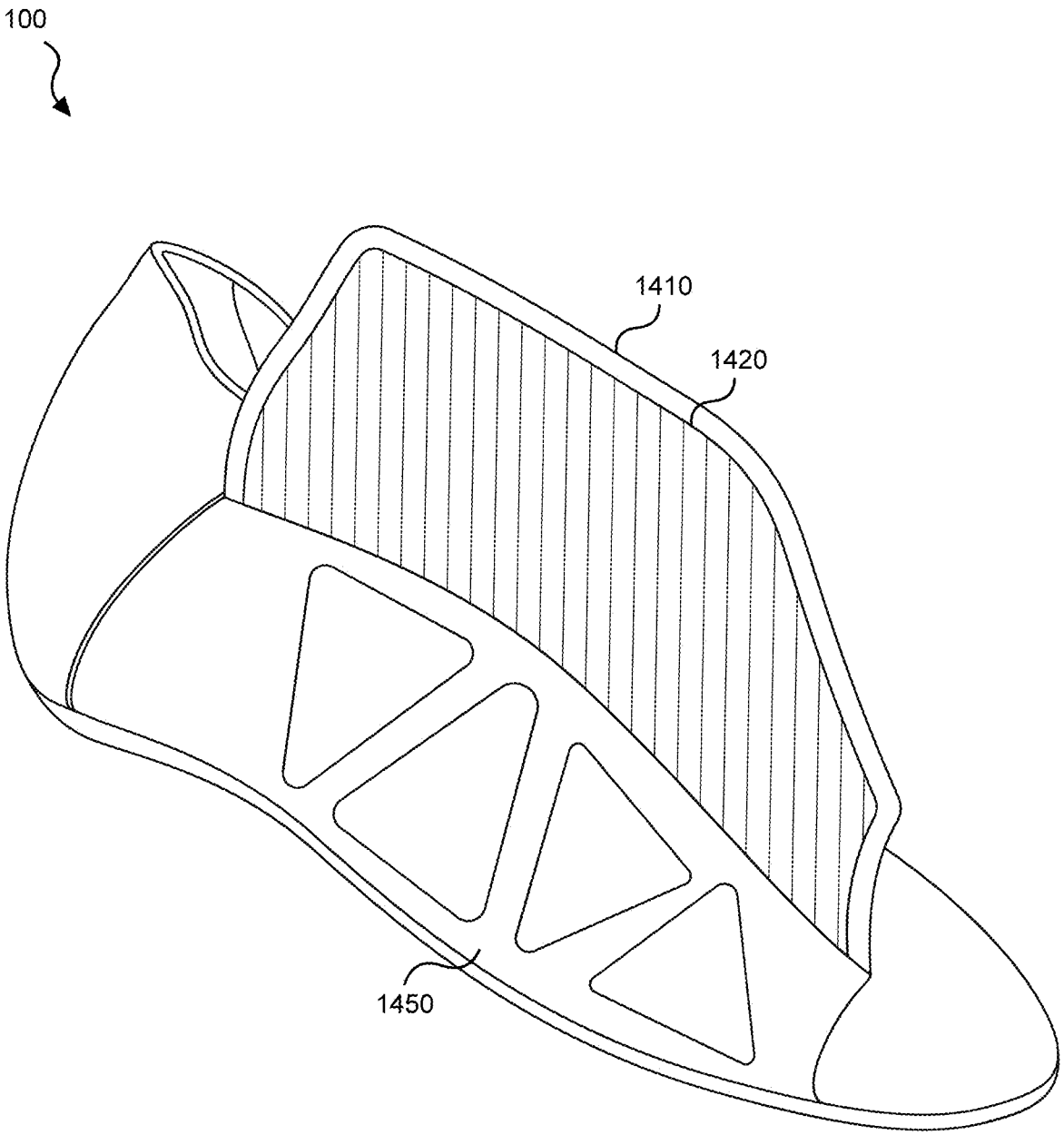
FIG. 15 illustrates an isometric view of the arrangement of layers of the upper of an article of footwear, according to the exemplary embodiment of FIG. 1.

FIG. 15 illustrates the arrangement of layers of the upper in the exemplary embodiment of the article of footwear. As shown, vamp overlay 1410 may be the outer most layer of upper 102 with vamp 1420, vamp lining 1430, vamp reinforcer 1440, and base vamp lining 1450 preceding. Vamp lining 1430 may be arranged between vamp 1420 and vamp reinforcer 1440, but is not shown in FIG. 15 because the textile may be configured to be a transparent material.

Figure 16:
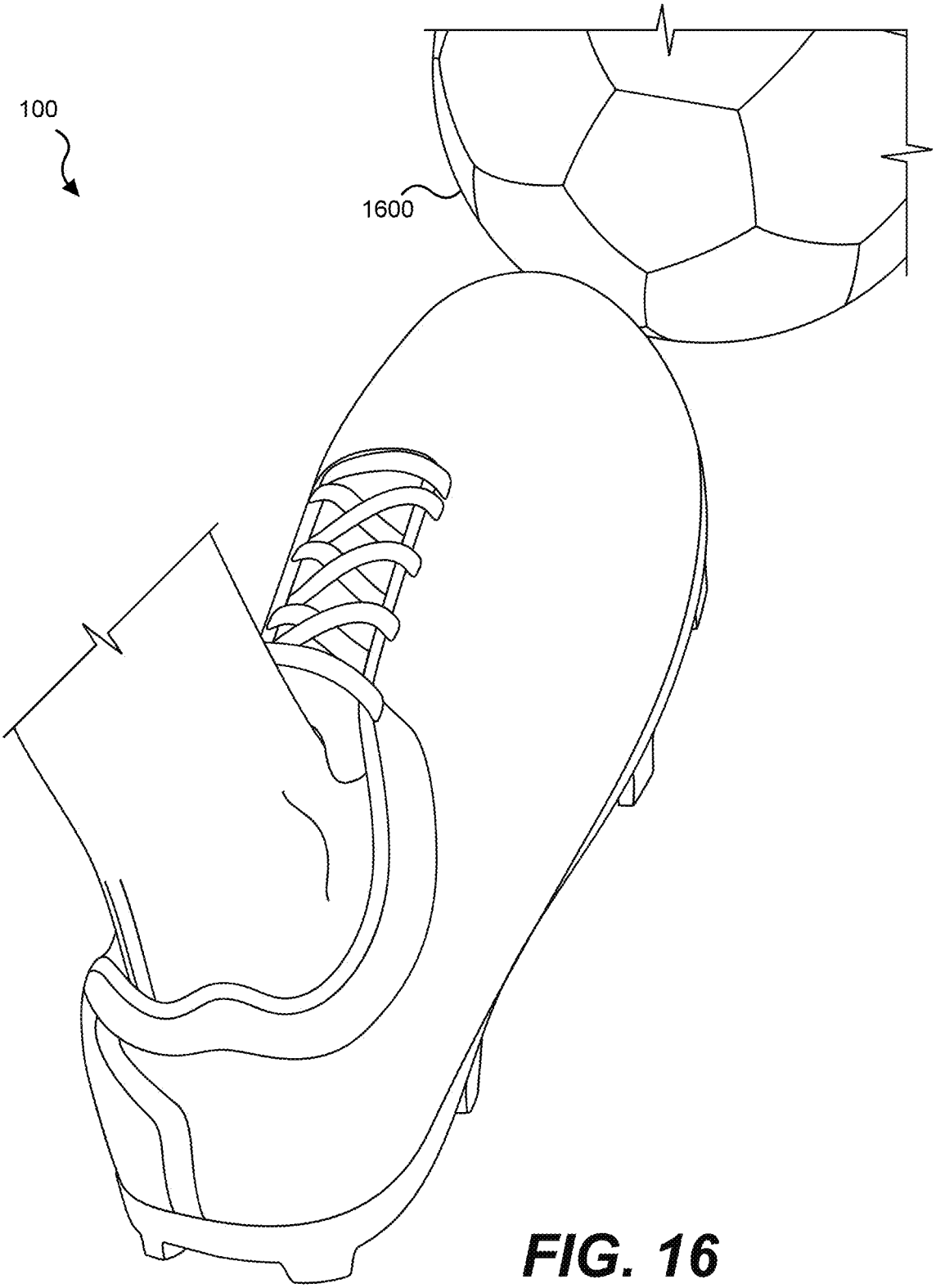
FIG. 16 illustrates the interaction of the article of footwear and a ball, according to the exemplary embodiment of the article of footwear of FIG. 1.

FIG. 16 illustrates the interaction of upper 102 with a ball in the exemplary embodiment of the article of footwear. In some example embodiments, article 100 may be configured for use in athletics such a soccer. The interaction of upper 102 and ball 1600 is an imperative consideration when choosing a textile or textiles for upper 102. The performance of the shoe is at least partially dependent on this interaction. For example, an increased grip or tackiness of upper 102 may provide the wearer with additional control over interactions with ball 1600. Therefore increasing the performance of article 100. Vamp overlay 1410 may be configured to provide increased grip or tackiness for interactions between article 100 and ball 1600 by increasing the coefficient of friction between the two materials.

I claim:

1. An article of footwear, comprising:
- a first end portion;
- a second end portion opposite the first end portion;
- an upper including a void space extending between the first end portion and the second end portion; and
- a sole structure comprising:
  - an outsole coupled to one or more cleats;
  - an insole opposite the outsole; and
  - a sockliner comprising a textile material, wherein the textile material has a first plurality of hooks extending from a top surface of the sockliner and a second plurality of hooks extending from a bottom surface of the sockliner at an oblique angle, wherein the bottom surface of the sockliner is configured to contact the insole.

2. The article of footwear of claim 1, wherein the first plurality of hooks extends from the top surface into the void space of the upper toward the first end portion.

3. The article of footwear of claim 2, wherein the first plurality of hooks is configured to contact a material covering a foot of a wearer and impede backward movement.

4. The article of footwear of claim 1, wherein the second plurality of hooks extends from the bottom surface of the sockliner toward the insole.

5. The article of footwear of claim 4, wherein the second plurality of hooks is configured to contact the insole to impede backward movement of the sockliner in the void space of the upper.

6. The article of footwear of claim 1, wherein the sockliner is made of a single textile material configured to increase a coefficient of friction between a foot of a wearer and the sockliner, and between the insole and the sockliner, while the foot of the wearer is in the void space of the upper.

7. The article of footwear of claim 1, wherein the second plurality of hooks is configured to extend from the bottom surface of the sockliner toward the second end portion.

8. An article of footwear, comprising:
- a first end portion and a second end portion opposite the first end portion;
- an upper including a void space extending between the first end portion and the second end portion; and
- a sole structure comprising:
  - an outsole coupled to one or more cleats; and
  - a sockliner disposed in the void space of the upper, comprising a first plurality of hooks and a second plurality of hooks, wherein each of the hooks of the first plurality of hooks uniformly extends from a top surface of the sockliner towards the first end portion, and wherein each of the hooks of the second plurality of hooks uniformly extends from a bottom surface of the sockliner towards the second end portion.

9. The article of footwear of claim 8, wherein first plurality of hooks extends from a top surface of the sockliner into the void space of the upper.

10. The article of footwear of claim 9, wherein the first plurality of hooks is configured to contact a material covering a foot of a wearer and impede backward movement.

11. The article of footwear of claim 8, the sockliner further comprising:
- a bottom surface comprising a textile material, wherein the textile material comprises a second plurality of hooks extending from the bottom surface of the sockliner toward an insole.

12. The article of footwear of claim 11, wherein the second plurality of hooks is configured to contact the insole to impede backward movement of the sockliner in the void space of the upper.

13. The article of footwear of claim 12, wherein the sockliner is made of a single textile material configured to increase a coefficient of friction between a foot of a wearer and the sockliner and between the insole and the sockliner, while the foot of the wearer is in the void space of the upper.

14. The article of footwear of claim 8, wherein a second plurality of hooks is configured to extend from a bottom surface of the sockliner toward the second end portion.

15. An article of footwear, comprising:
- a first end portion;
- a second end portion opposite the first end portion;
- an upper including a void space extending between the first end portion and the second end portion; and
- a sole structure comprising:
  - an outsole including a plurality of protrusions coupled to the outsole configured to provide traction with a ground surface;
  - an insole opposite the outsole; and
  - a sockliner disposed above the insole comprising a top surface and a bottom surface, wherein the bottom surface is configured to contact the insole, wherein the sockliner comprises a textile material having a first plurality of hooks extending from the top surface and a second plurality of hooks extending from the bottom surface of the sockliner at an oblique angle, wherein the first plurality of hooks and the second plurality of hooks extend from the sockliner in opposite directions.

16. The article of footwear of claim 15, wherein the first plurality of hooks is configured to impede a foot of a wearer from moving backward within the void space of the upper.

17. The article of footwear of claim 16, wherein the first plurality of hooks is configured to contact a material covering the foot of the wearer.

18. The article of footwear of claim 15, wherein the second plurality of hooks extends from the bottom surface of the sockliner toward the insole.

19. The article of footwear of claim 18, wherein the second plurality of hooks is configured to extend from the bottom surface of the sockliner toward the second end portion.

20. The article of footwear of claim 15, wherein the sockliner is made of a single textile material configured to increase a coefficient of friction between a foot of a wearer and the sockliner when removing the foot from the article of footwear.

* * * * *